US007497003B2

(12) United States Patent
Tanaka et al.

(10) Patent No.: US 7,497,003 B2
(45) Date of Patent: Mar. 3, 2009

(54) APPARATUS AND METHOD FOR SUPPORTING SPEAKER DESIGN, AND PROGRAM THEREFOR

(75) Inventors: Akira Tanaka, Kyoto (JP); Kazuki Honda, Mie (JP); Koji Sano, Mie (JP); Tomoko Handa, Osaka (JP)

(73) Assignee: Panasonic Corporation, Osaka (JP)

( * ) Notice: Subject to any disclaimer, the term of this patent is extended or adjusted under 35 U.S.C. 154(b) by 1268 days.

(21) Appl. No.: 10/400,473

(22) Filed: Mar. 28, 2003

(65) Prior Publication Data

US 2003/0200068 A1 Oct. 23, 2003

(30) Foreign Application Priority Data

Mar. 29, 2002 (JP) ..... 2002-096206

(51) Int. Cl.
*H04R 31/00* (2006.01)

(52) U.S. Cl. ..... 29/594; 703/2; 381/59

(58) Field of Classification Search ..... 381/58–59, 381/111, 116–117, 11; 703/2; 29/594, 609.1, 29/729, 5.94
See application file for complete search history.

(56) References Cited

U.S. PATENT DOCUMENTS 3,988,541 A * 10/1976 Boast ..... 381/98
5,664,023 A * 9/1997 Button ..... 381/400
5,664,203 A * 9/1997 Hong et al. ..... 713/323
6,269,318 B1 * 7/2001 Geddes ..... 702/109
7,054,460 B2 * 5/2006 Rombach et al. ..... 381/421
7,184,556 B1 * 2/2007 Johnson et al. ..... 381/61

FOREIGN PATENT DOCUMENTS

JP 2001-104522 4/2001
WO WO 01/11918 A2 2/2001

OTHER PUBLICATIONS

Japanese Office Action, with English Translation, issued in Japanese Patent Application No. JP 2002-096206, dated Apr. 9, 2008.

* cited by examiner

*Primary Examiner*—Vivian Chin
*Assistant Examiner*—Disler Paul
(74) *Attorney, Agent, or Firm*—McDermott Will & Emery LLP

(57) ABSTRACT

The speaker design support apparatus can reduce time for designing the speaker instead of many design trials, and comprises the input means that a user inputs necessary data for voice coil and for magnetic circuit and for diaphragm, and the calculation means for calculate the speaker characteristic based on the inputted data from the input means, and the display for displaying the calculated results by the calculation means.

33 Claims, 16 Drawing Sheets

APPARATUS AND METHOD FOR SUPPORTING SPEAKER DESIGN, AND PROGRAM THEREFOR

BACKGROUND OF THE INVENTION

1. Field of the Invention

This invention relates to a speaker design support apparatus and a speaker design support method for supporting the designing for a speaker comprising a voice coil, a magnetic circuit, and so on.

2. Description of the Related Art

So far, the speaker has been applied to an audio system or the like. Recently, it is also applied to various devices such as a mobile phone. The mobile phone is required to be downsized and to be provided with the high performance. In order to manufacture the downsized mobile phone with high performance feature, the mobile phone makers impose many requirements (target specifications) on the speaker makers regarding the size, the sound pressure, the mode pattern, and etc. Accordingly, the speaker makers will manufacture the speaker meeting the requirements.

And now, a configuration of the speaker is explained according to FIG. 7. As shown in FIG. 7, a cylindrical magnet 73 is placed at the center of a patelliform yoke 74 with U-shaped section keeping a specific distance from a sidewall of the yoke 74, and a magnetic plate 72 is placed on this magnet 73. A bobbin 76 provided so as to be perpendicular to a diaphragm 75 of the speaker is inserted into a gap between the plate 72 and the yoke 74. A coil 71 winds around the bobbin 76. The diaphragm 75 comprises a diaphragm body 751 at the center and edge 752 on the periphery of the diaphragm body 751. The edge 752 is bonded to a frame 77. According to such configuration, a closed magnetic circuit is consisted of the magnet 73, the plate 72 and the yoke 74. When the voice electric current flows on the coil 71 wound around the bobbin 76 placed in the gap, the diaphragm 75 vibrates by the electromagnetic force.

The frame 77 is provided with a through-hole 77*a* to control an excursion of the diaphragm 75 under the low frequency band. An acoustic resistance member 77*b* covering through-hole 77*a* is equipped at the outside of the frame 77's back. The front side of the speaker is provided with a protector 78 to protect the diaphragm 75 and etc. Besides, the protector 78 is provided with a plurality of through-holes.

The speaker is provided with the voice coil 71; the magnetic circuit comprising the plate 72, the magnet 73 and the yoke 74; and the diaphragm 75, as mentioned above. Therefore, It is very important for the speaker designing to design the voice coil 71, the magnetic circuit, and the diaphragm 75.

A designer manufactures a speaker by way of trial after designing the voice coil 71, the magnetic circuit, and the diaphragm 75. And, the designer evaluates whether the trail speaker meets the above-mentioned requirements regarding the sound pressure, the mode pattern, and the like.

If it fills the requirements, the trial speaker is shipped as a sample to the above mobile phone makers. If not, the designer goes back to the steps for designing the voice coil, the magnetic circuit, and the diaphragm.

The characteristic of a voice coil 71 depends on a coil diameter, a material and a diameter of a wire rod, a winding pattern, and the number of windings. For this reason, when the designer designs the voice coil 71 with a given characteristic, it is necessary to properly determine a coil diameter, a material and a diameter of a wire rod, a winding pattern of the wire rod, and the number of windings. However, there are likely two or more examples of respective items necessary for designing the voice coil 71 such as the coil diameter, the material and the diameter of the wire rod, and the like. And, many cases can be considered as the combination of the items. Accordingly, it is not easy to design the voice coil 71 with the specific characteristic and hard to finish the design in a short time.

The magnetic circuit has a different characteristic such as the magnetic flux density and the like depending on respective materials and sizes of the plate 72, the magnet 73, and the yoke 74 composing the magnetic circuit. The designer has to properly determine a material and a size of each component member of the magnetic circuit. Therefore, it is difficult to finish the design of the magnetic circuit in a short time. Similarly, it is also difficult to finish the design of the diaphragm in a short time.

In addition, the speaker characteristic is determined according to the multiplex relation among respective shapes of the voice coil, the magnetic circuit, and the diaphragm. Accordingly, even if it is completed to design the voice coil, the magnetic circuit and the diaphragm respectively, the characteristic of the speaker such as the sound pressure is not determined before studying the mutual relations of the voice coil, the magnetic circuit, and the diaphragm. When the speaker is assembled by combining the voice coil, the magnetic circuit, and the diaphragm that have been manufactured experimentally based on the design, the assembled speaker naturally meets the requirements imposed by the mobile phone maker, but seldom. If the speaker meets no requirements, it is necessary to redesign the voice coil, the magnetic circuit and the diaphragm in order to assemble another speaker. It is general that the speaker as trial product is made up plural times. The design of the speaker in the past needs a very long time, e.g. a few weeks.

The designers design a voice coil, a magnetic circuit and a diaphragm according to their own experience. When an unskilled person designs a speaker, the unskilled person needs more time to design the speaker than a skilled person or cannot design the speaker according to the circumstance.

SUMMARY OF THE INVENTION

The invention has been proposed on consideration of such conventional problem that it is not possible to design the speaker in a short time, and an object thereof is to provide a speaker design support apparatus and a speaker design support method that enable to design the speaker in a short time.

In order to solve the above problem and achieve the object, the present invention provides a speaker design support apparatus which comprises input means for inputting necessary items to design a voice coil, a magnetic circuit and a diaphragm by a user; calculation means for calculating the speaker characteristic based on the data inputted from the input means; and display means for displaying results calculated by the calculation means.

The present invention further provides a speaker design support apparatus which comprises preprocessing means for calculating shapes of the voice coil and the magnetic circuit; magnetic circuit design means for obtaining the magnetic flux density distribution for the magnetic circuit based on the voice coil shape and the magnetic circuit shape; intermediate processing means for obtaining a factor of force acting on the voice coil and an effective vibration system mass based on the voice coil shape, the magnetic circuit shape, and the magnetic flux density distribution for the magnetic circuit; and equivalent circuit design means for obtaining an equivalent circuit of a speaker based on the voice coil shape, the magnetic circuit shape, the factor of force acting on the voice coil, and the effective vibration system mass.

By using the speaker design support apparatus of this invention, it is possible to finish a design of a speaker with less frequency of manufacturing a speaker by way of trial than before, and it makes possible to design the speaker in a short time. More specifically, it enables even unskilled person to design the speaker in a short time same as the skilled person. In addition, the speaker design support apparatus configured as above can be carried out by the general-purpose personal computer.

The preferred embodiments of the invention are described hereinafter according to attached drawings.

DESCRIPTION OF THE PREFERRED EMBODIMENTS

First Embodiment

The followings explain about a configuration of a speaker design support apparatus in the present embodiment together with the operation, referring to the figures.

Figure 1:
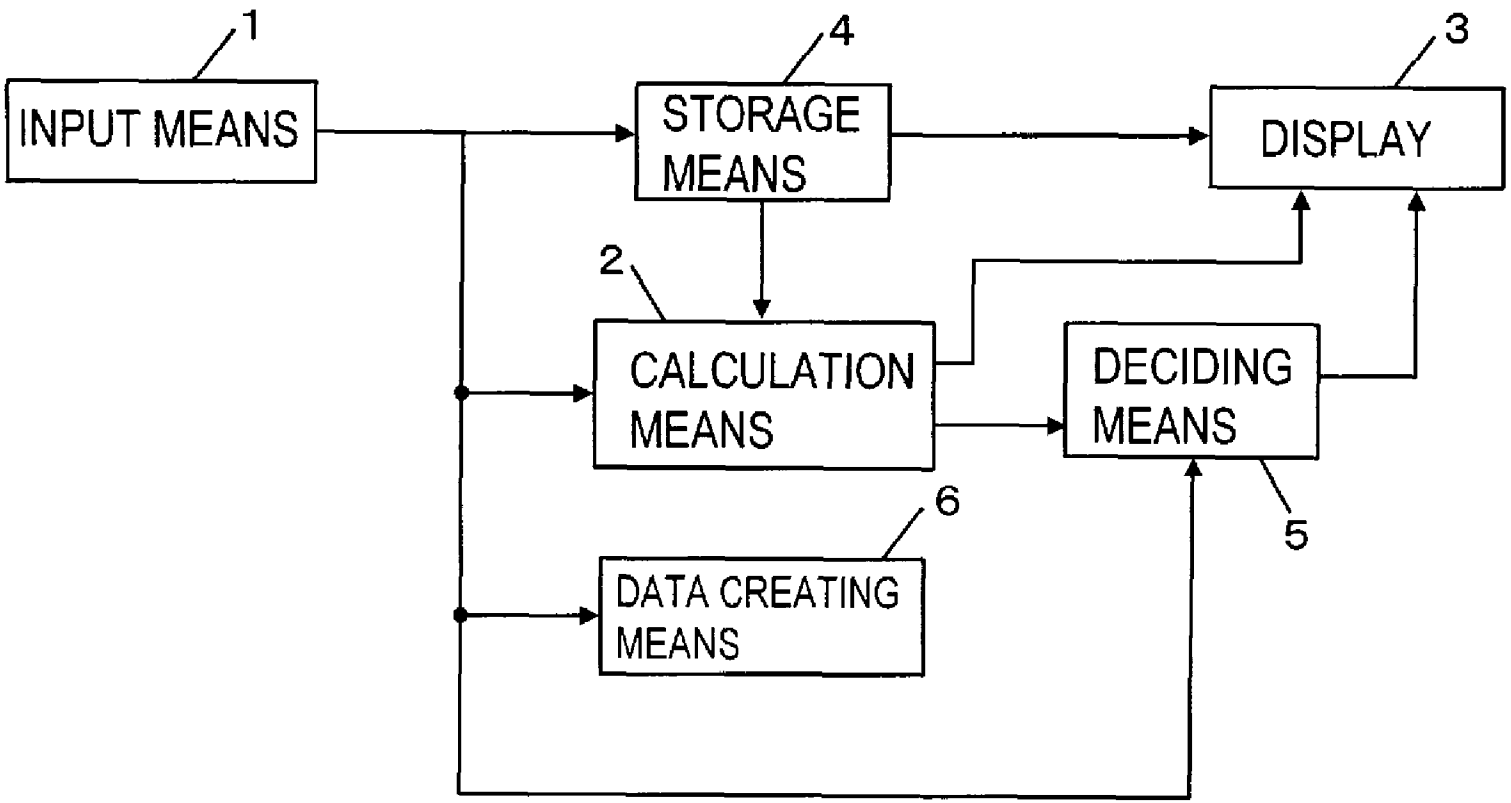
FIG. 1 is a schematic block diagram of the speaker design support apparatus in the first embodiment.
Figure 2:
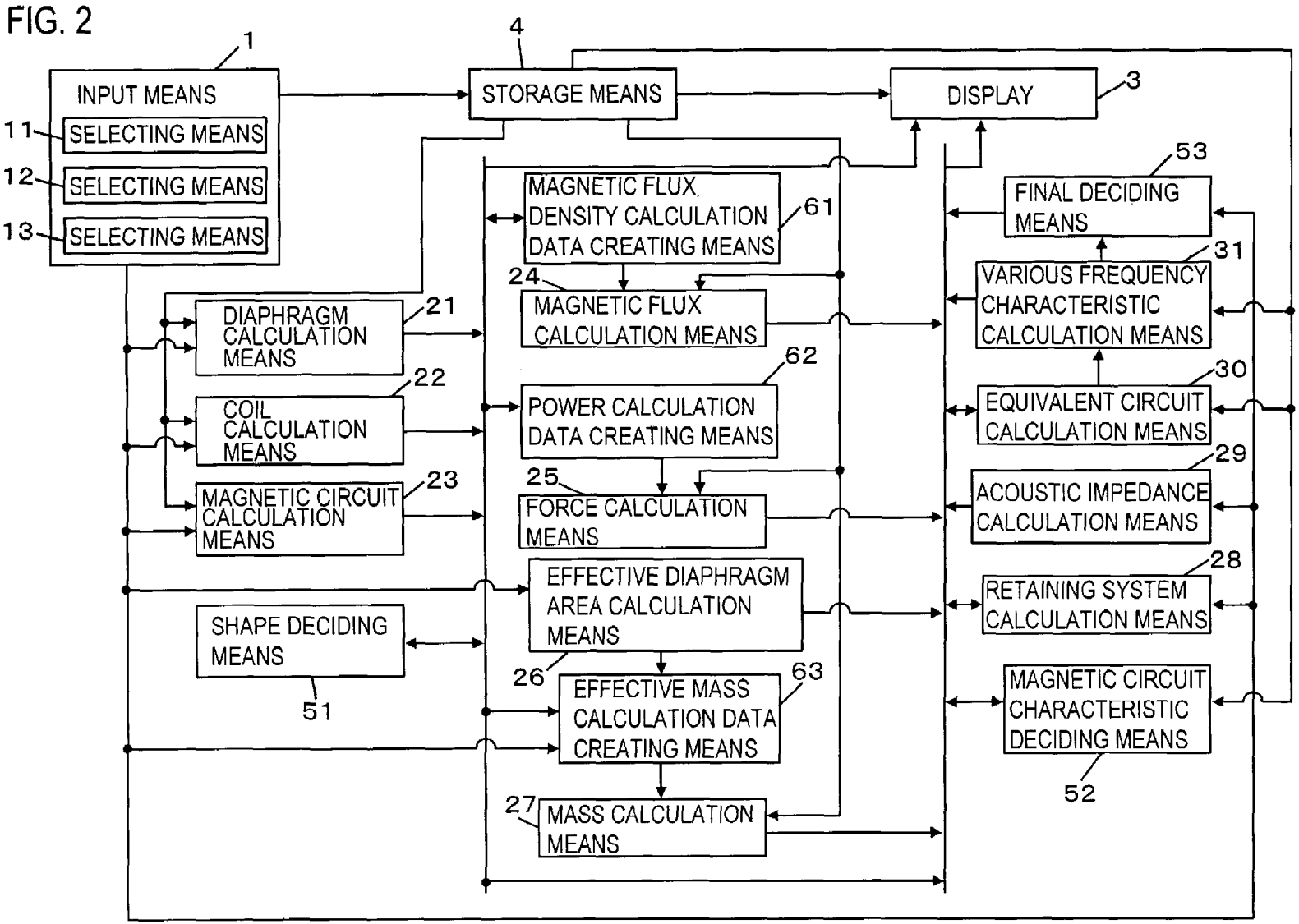
FIG. 2 is a detailed block diagram of the speaker design support apparatus in the first embodiment.
Figure 3:
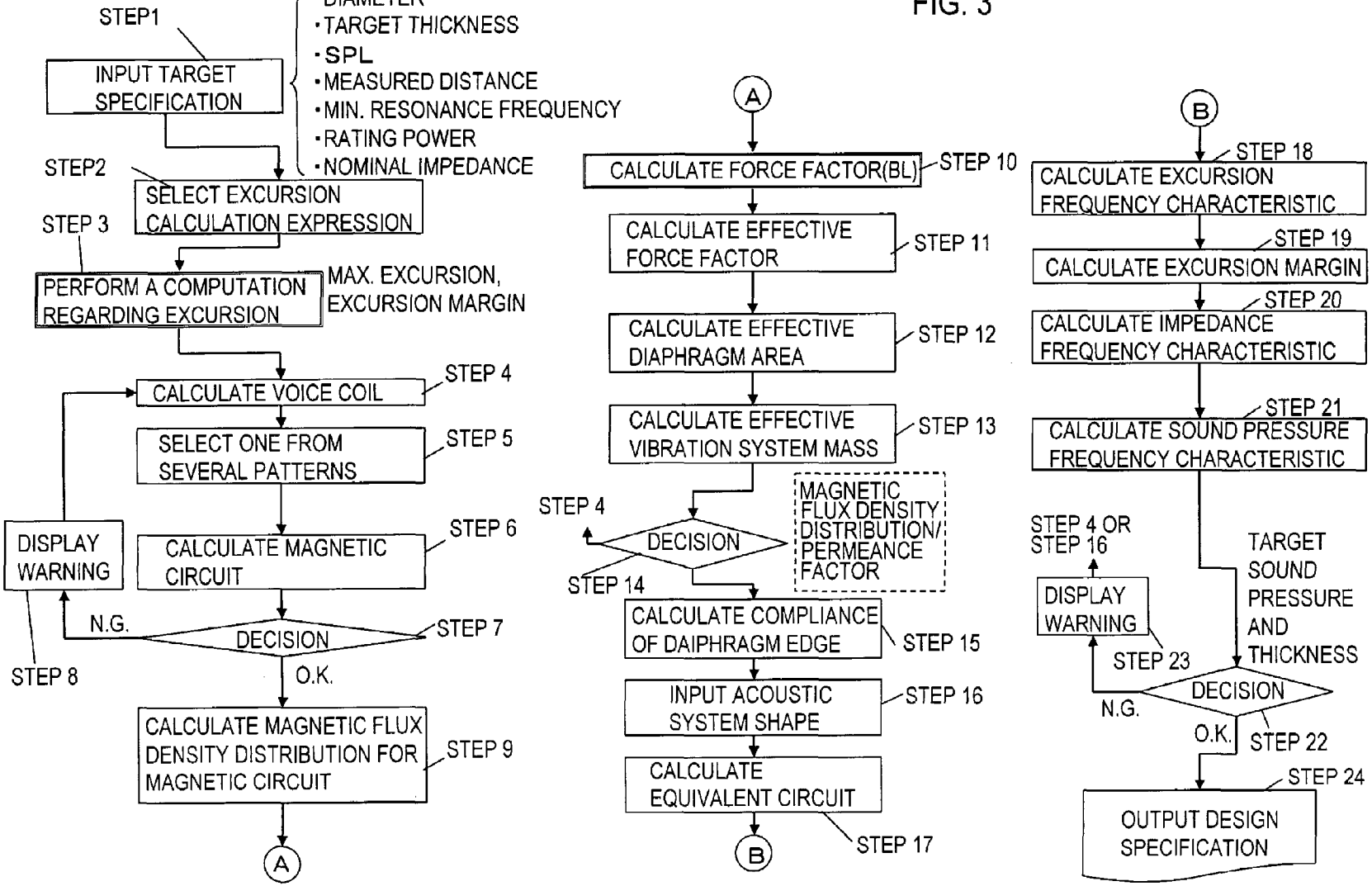
FIG. 3 is a diagram explaining an operation of the speaker design support apparatus in the first embodiment.

FIG. 1 shows a schematic configuration of the speaker design support apparatus. As shown in FIG. 1, the speaker design support apparatus comprises input means 1, calculation means 2, display 3, storage means 4, deciding means 5 and data creating means 6. And FIG. 2 shows a detailed configuration of the speaker design support apparatus of the first embodiment. FIG. 3 shows operating procedures of the speaker design support apparatus.

A user of the speaker design support apparatus, such as a designer of speaker makers, inputs to the speaker design support apparatus various requirements (target specifications) of a speaker presented by a mobile phone maker by means of the input means 1 like a keyboard. The requirements such as a diameter, a target thickness, a target SPL (target sound pressure), a measured distance, a minimum resonance frequency Fs, a rating power, nominal impedance, and an effective vibration diameter, are inputted (Step 1 in FIG. 3). Specifically, by means of the input means 1, the user inputs the requirements showing in table 1, that is, 22 mm as diameter, 5 mm as target thickness, 82 dB as target SPL, 1 m as measured distance, 800 Hz as minimum resonance frequency Fs, 0.5 W as rating power, 8 Ω as nominal impedance, and 14.5 mm as effective vibration diameter. And the contents of the following Table 1 inputted by the input means 1 are displayed on the display 3.

TABLE 1

| Description | Unit of quantity | Value |
|---|---|---|
| Diameter | mm | 22 |
| Target thickness | mm | 5 |
| Target SPL | dB | 82 |
| Measured distance | m | 1 |
| Min. resonance frequency Fs | Hz | 800 |
| Rating power | W | 0.5 |
| Nominal impedance | Ω | 8 |
| Effective vibration diameter | mm | 14.5 |
| Max. excursion | mm | |
| Excursion margin | mm | |

And now, if it is possible to obtain approximate values of a maximum excursion and an excursion margin for the diaphragm composing the speaker, the user can decide approximately whether the diaphragm touches the protector of the speaker and whether the voice coil vibrating with the diaphragm touches the magnetic circuit. Accordingly, after the above requirements are inputted as above, the display 3 as display means displays two approximate-excursion calculating expressions shown as the following Expressions 1 and 2, those expressions stored in the storage means 4. Expression 1 of the approximate-excursion calculating expressions is for calculating a maximum excursion and an excursion margin of a predetermined standard diaphragm (which is called hereinafter the maximum excursion and the excursion margin of the standard design) when the speaker provided with the standard diaphragm is made to satisfy the requirements. Expression 2 is for calculating a maximum excursion and an excursion margin of a predetermined worst-case diaphragm (which is called hereinafter the maximum excursion and excursion margin of the worst-case design; the worst case is the one predetermined within a specific limit of the requirements) when the speaker provided with the worst-case diaphragm is made to satisfy the requirements.

$$\text{Max. Excursion}(X\text{max1}) = v/j\omega$$

$$\text{Excursion Margin}(X\text{mgn1}) = X\text{max1} \times \text{Safety Factor}$$

$$v = 2 \times r \times p/(\rho_0 \times \omega \times a^2) \qquad \text{Expression 1:}$$

r: Distance between a speaker and means for detecting sound from the speaker $p = 10^{(SPL/20)} \times 2 \times 10^{-5}$ $\rho_0$: Air density
$\omega=2\times\pi\times fs$
fs: Frequency
a=Effective vibration diameter/2

$$\text{Max.Excursion}(X\text{max2})=v_2/(j\omega\times\text{Safety factor})$$

$$\text{Excursion Margin}(X\text{mgn2})=X\text{max2}+\text{Component Assembly Tolerance}$$

$$v_2=2\times r\times p/(\rho_0\times\omega\times\text{Safety Factor}\times a^2)$$

r: Distance between a speaker and means for detecting sound from the speaker
$p=10^{(SPL/20)}\times 2\times 10^{-5}$
$\rho_0$: Air density
$\omega=2\times\pi\times fs$
fs: Frequency
a=Effective vibration diameter/2

When the display 3 displays the approximate-excursion calculating expressions such as the above Expressions 1 and 2, if the user wants to know the maximum excursion and excursion margin of standard design, he or she selects Expression 1 by means of selecting means 11 (Step 2). Or, if he or she wants to know the maximum excursion and the excursion margin of the worst-case design, he or she selects Expression 2 by means of. selecting means 11 (Step 2). After Expression 1 or 2 is selected, diaphragm calculation means 21 calculates the selected Expression 1 or 2 by substituting necessary data for calculating the maximum excursion and the excursion margin of the diaphragm out of the data inputted by the input means 1, with the result that the approximate values of the maximum excursion and the excursion margin for the diaphragm are obtained (Step 3). And then the calculated result is displayed on the display 3 together with the requirements. For instance, when Expression 1 is selected, it results that the maximum excursion is 0.45 mm and the excursion margin is 0.69 mm, as shown in Table 2. And the result is displayed on the display 3.

TABLE 2

| Description | Unit of quantity | Value |
|---|---|---|
| Diameter | mm | 22 |
| Target thickness | mm | 5 |
| Target SPL | dB | 82 |
| Measured distance | m | 1 |
| Min. resonance frequency | Hz | 800 |
| Rating power | W | 0.5 |
| Nominal impedance | Ω | 8 |
| Effective vibration diameter | mm | 14.5 |
| Max. Excursion | mm | 0.45 |
| Excursion margin | mm | 0.69 |

Besides, the embodiment may be arranged so as to display both values of the standard design and the worst-case design on the display 3 after the user selects both of Expressions 1 and 2 simultaneously.

If the approximate values of the maximum excursion and the excursion margin of the diaphragm are presented as described above, the user can decide approximately whether the diaphragm touches the protector of the speaker, and whether the voice coil vibrating with the diaphragm touches the magnetic circuit.

Next, the user inputs to the speaker design support apparatus a command to present a shape (size, for example) of the voice coil composing the speaker together with necessary items to design the voice coil by means of the input means 1. For instance, as shown in the following Table 3, respective data show that the nominal diameter is 8 mm, the wire rod name is a copper wire, the wire diameter is 0.06 mm, the maximum coil diameter is 0.08 mm, the number of layers is 2, the bobbin material is paper, the bobbin thickness is 50 μm, and the bobbin margin is 0.1 mm. The user inputs from the input means 1 such data as an example of necessary items for designing the voice coil. Besides, the contents shown as Table 3, which are the data inputted by the input means 1, are displayed on the display 3.

TABLE 3

| Description | Unit of quantity | Value |
|---|---|---|
| Nominal diameter | mm | 8 |
| Wire rod name | | Copper wire |
| Wire diameter | mm | 0.06 |
| Maximum coil diameter | mm | 0.08 |
| Number of layers | Layer(s) | 2 |
| Bobbin material | | Paper |
| Bobbin thickness | μm | 50 |
| Bobbin margin | mm | 0.1 |
| Bobbin height | mm | |
| Gold thread mass | mg | |
| Winding width | mm | |
| Winding number | Turn(s) | |
| Wire length | m | |
| Direct current resistance (DCR) | Ω | |
| Coil mass | mg | |
| Total mass | mg | |
| Max. Voice coil diameter | mm | |
| Voice coil inductance | H | |

And, coil calculation means 22 performs a computation by substituting necessary data inputted from the input means 1 for calculating the voice coil shape into a plurality of coil calculating expressions stored in the storage means 4 respectively, with the result that the voice coil shape is obtained (Step 4).

The plurality of coil calculating expressions is shown as the following Expressions 3 and 4, for example. Expression 3 of those two coil calculating expressions is to obtain a bobbin height (Hvc) as an example of the voice coil shape, and Expression 4 is to obtain a winding width (Wvc).

$$\text{BobbinHeight}(Hvc)=\text{Max.Excursion}(X\text{max1})\times\text{Safety-Factor}\times\text{Winding Width}(Wvc)+\text{Bobbin Margin}(Hbs) \quad \text{Expression 3:}$$

$$\text{Winding Width}(Wvc)=\text{Max.CoilDiameter}(Dw\text{max})\times\text{Winding Number of First Layer} \quad \text{Expression 4:}$$

In this case, the coil calculation means 22 obtains the calculated result that, as an example of the voice coil shape, the bobbin height (Hvc) and the winding width (Wvc) are 2.93 mm and 1.84 mm respectively, and then the data is displayed on the display 3.

And now, there are occasions when the user inputs plural patterns of necessary items for designing the voice coil and compares respective results calculated based on the plural patterns. For instance, in case of calculating the bobbin height (Hvc) and the winding width (Wvc), the user inputs three patterns to which respective values of the maximum coil diameter (Dwmax), the winding number of the first layer, and the bobbin margin (Hbs) are combined. At this time, the display 3 displays the results of calculating the bobbin height (Hvc) and the winding width (Wvc) for each pattern. Hereupon, the user selects either one from three patterns by using selecting means 12 (Step 5), and the shape of the voice coil (an example of shape) is decided.

In addition, according to the data that "the nominal diameter is 8 mm, the wire rod name is a copper wire, the wire diameter is 0.06 mm, the maximum coil diameter is 0.08 mm, and the number of layers is 2", the coil calculation means 22 obtains calculated results that the direct current resistance (DCR) Re is 7.32 Ω and the inductance Le is 0.0001H. Each value of the direct current resistance and the inductance Le is displayed on the display 3. And each value of the direct current resistance and the inductance Le is used respectively as a resistance value and an inductance value of the coil, which are electric element parts of the after-mentioned equivalent circuit (See FIG. 6).

Based on the necessary data for calculating the voice coil shape that the user inputs from the input means 1, the coil calculation means 22 also obtains calculated results that the gold thread mass is 0.2 mg, the winding number is 45 turns, the wire length is 1.21 m, the coil mass is 34.1 mg, the total mass is 37.34mg, and the maximum diameter of voice coil is 8.69 mm.

The results thus calculated by the coil calculation means 22 are displayed on the display 3 in the form shown in the following Table 4 together with the necessary items for designing the voice coil inputted by the user.

TABLE 4

| Description | Unit of quantity | Value |
|---|---|---|
| Nominal diameter | mm | 8 |
| Wire rod name | | Copper wire |
| Wire diameter | mm | 0.06 |
| Maximum coil diameter | mm | 0.08 |
| Number of layers | Layer(s) | 2 |
| Bobbin material | | Paper |
| Bobbin thickness | μm | 50 |
| Bobbin margin | mm | 0.1 |
| Bobbin height | mm | 2.93 |
| Gold thread Mass | mg | 0.2 |
| Winding width | mm | 1.84 |
| Winding number | Turn(s) | 45 |
| Wire length | m | 1.21 |
| Direct current resistance (DCR) | Ω | 7.32 |
| Coil mass | mg | 34.1 |
| Total mass | mg | 37.34 |
| Max. Voice coil diameter | mm | 8.69 |
| Voice coil inductance | H | 0.0001 |

Besides, concrete examples of the diameter of the wire rod of the above coil are stored in the storage means 4, either one of which is selected by the user by means of the selecting means 13. The selected one is regarded as the data that the user inputs from the input means 1. For instance, the storage means 4 stores values of 0.04 mm, 0.05 mm, and 0.06 mm as the diameter of the wire rod of the coil, and the user selects "0.006 mm" by means of the selecting means 13. The concrete example of such case is shown as the above table (See Table 3). The value "0.006 mm" is treated as data of the diameter of the wire rod of the coil inputted by the user from the input means 1. Here, the user may input, by using the input means 1, the other data except the examples stored in the storage means 4.

Examples of the wire rod names can be also stored in the storage means 4 in advance. The user selects either one from those examples stored in the storage means 4 by using the selecting means 13. The selected one may be regarded as the wire rod name that the user inputs from the input means 1.

Next, the user inputs to the speaker design support apparatus a command to present a size (an example of the shape) of the magnetic circuit composing the speaker together with necessary items for designing the magnetic circuit by using the input means 1. For instance, as shown in the following Table 5, respective data are that the plate diameter is 7.9 mm, the plate thickness is 0.5 mm, the plate material is SS41, the magnet diameter is 7.4 mm, the magnet thickness is 1.2 mm, the magnet material is neodymium (BHmax=35), the yoke bore is 9 mm, the yoke thickness is 0.6 mm, and the yoke material is SS41. The user inputs from the input means 1 such data as an example of necessary items for designing the magnetic circuit. Here, the contents of Table 5 showing the data inputted by the input means 1 are displayed on the display 3.

TABLE 5

| Description | Unit of quantity | Value |
|---|---|---|
| Plate diameter | mm | 7.9 |
| Plate thickness | mm | 0.5 |
| Plate material | | SS41 |
| Magnet diameter | mm | 7.4 |
| Magnet thickness | mm | 1.2 |
| Magnet material | | Neodymium (BHmax = 35) |
| Yoke bore | mm | 9 |
| Yoke thickness | mm | 0.6 |
| Yoke height | mm | |
| Yoke material | | SS41 |

Magnetic circuit calculation means 23 performs a computation by substituting necessary data inputted from the input means 1 for calculating the size of the magnetic circuit into a magnetic circuit calculating expression stored in the storage means 4, in result the size of the magnetic circuit is obtained (Step 6).

The circuit calculating expression is represented as the following Expression 5, which is to obtain a yoke height (Hy).

$$\text{YokeHeight}(Hy)=\text{PlateThickness}(Tp)+\text{MagnetThickness}(Tm)+\text{YokeThickness}(Ty) \quad \text{Expression 5:}$$

The yoke height (Hy) thus obtained by the magnetic circuit calculation means 23 is displayed on the display 3 in the form shown in the following Table 6, together with the necessary items inputted by the user for designing the magnetic circuit.

TABLE 6

| Description | Unit of quantity | Value |
|---|---|---|
| Plate diameter | mm | 7.9 |
| Plate thickness | mm | 0.5 |
| Plate material | | SS41 |
| Magnet diameter | mm | 7.4 |
| Magnet thickness | mm | 1.2 |
| Magnet material | | Neodymium (BHmax = 35) |
| Yoke bore | mm | 9 |
| Yoke thickness | mm | 0.6 |
| Yoke height | mm | 2.3 |
| Yoke material | | SS41 |

Besides, the above explanation notes that the step of calculating the magnet circuit (Step 6) is executed after the steps of calculating the voice coil (Step 4) and selecting pattern (Step 5), however, those steps of calculating the voice coil (Step 4) and selecting pattern (Step 5) may be executed after the step of calculating the magnetic circuit (Step 6).

Next, based on the maximum excursion and the excursion margin of the diaphragm obtained by the diaphragm calculation means 21, the voice coil shape (size) obtained by the coil calculation means 22, and the magnetic circuit shape (size) obtained by the magnetic circuit calculation means 23, shape deciding means 51 performs a following decision step (Step 7).

Figure 7:
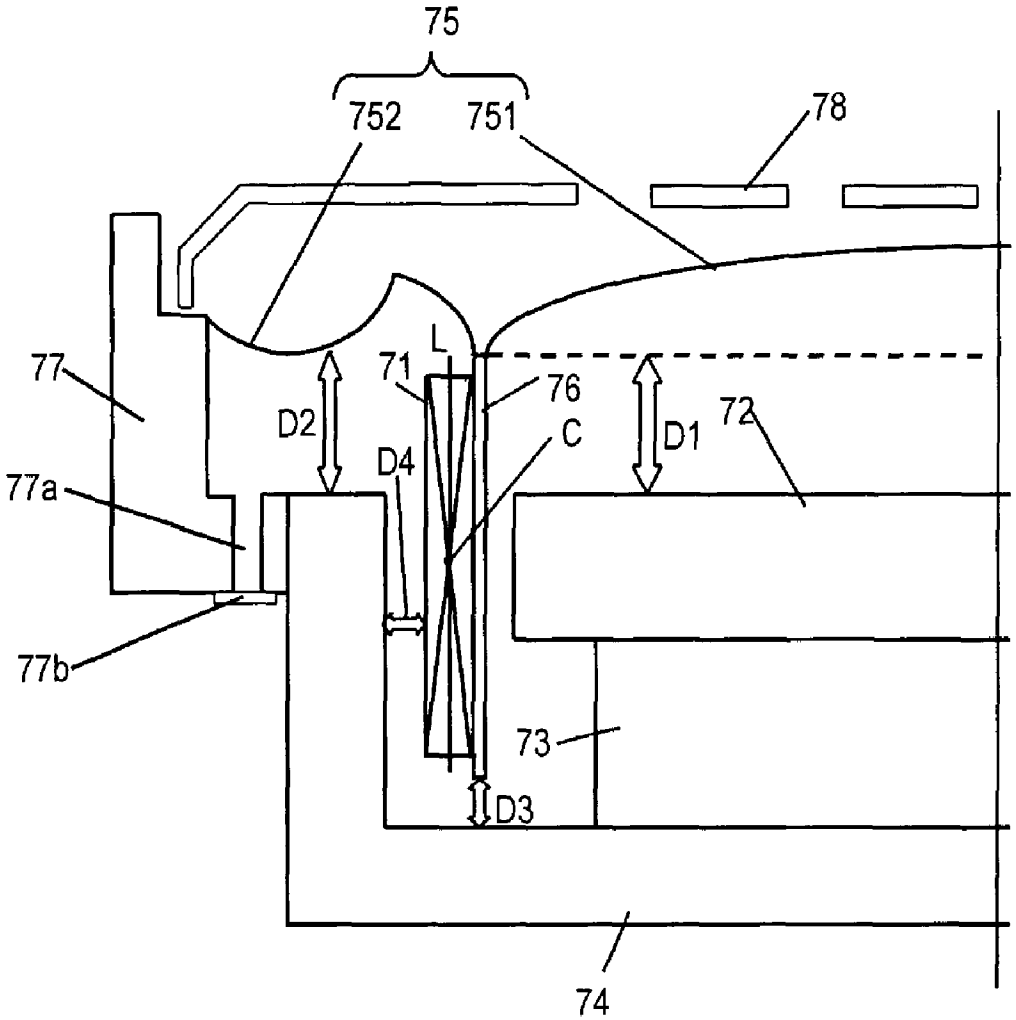
FIG. 7 is a sectional view of the speaker.

The decision step is explained here according FIG. 7. In the first place, when the diaphragm 75 vibrates together with the vibration of the voice coil 71, the shape deciding means 51 decides whether the diaphragm body 751 touches the plate 72 composing the magnetic circuit. That is to say, the shape deciding means 51 decides whether a distance D1 between the plate 72 and the diaphragm body 751, which is shown in FIG. 7, can be kept in the range that the plate 72 does not touch the diaphragm body 751 when the diaphragm 75 vibrates.

In the second place, when the diaphragm 75 vibrates together with the vibration of the voice coil 71, the shape deciding means 51 decides whether the diaphragm edge 752 touches the yoke 74. That is to say, the shape deciding means 51 decides whether a distance D2 between the diaphragm edge 752 and the yoke 74, which is shown in FIG. 7, can be kept in the range that the diaphragm edge 752 does not touch the yoke 74 when the diaphragm 75 vibrates.

In the third place, when the voice coil 71 vibrates, the shape deciding means 51 decides whether the bobbin 76 touches the yoke 74 in the vibration direction of the voice coil. That is to say, the shape deciding means 51 decides whether a distance D3 between the bobbin 76 and the yoke 74, which is shown in FIG. 7, can be kept in the range that the bobbin 76 does not touch the yoke 74 when the voice coil 71 vibrates. Besides, the above explanation notes the deciding step in a case where the voice coil is provided with the bobbin 76. However, in case where the voice coil is not provided with the bobbin 76, the shape deciding means 51 decides whether the voice coil 71 touches the yoke 74 in the vibration direction of the voice coil 71 when the voice coil 71 vibrates, In the fourth place, the shape deciding means 51 decides whether the voice coil 71 touches the yoke 74 in the direction perpendicular to the vibration direction of the voice coil 71. That is to say, it is decided whether a distance D4 between the voice coil 71 and the yoke 74, which is shown in FIG. 7, can be kept in the range that the voice coil 71 and the yoke 74 does not touches each other.

Additionally, in the fifth place, though the speaker shown in FIG. 7 is provided with the bobbin 76, the shape deciding means 51 decides whether the bobbin 76 is required or not to connect the voice coil 71 and the diaphragm 75.

Those decision results by the shape deciding means 51 are displayed on the display 3. At this time, if any one of the five decision items results in a negative decision, it is decided that the speaker shape is out of the limited range, and a warning is displayed (Step 8). And then, the processing goes back to a step of calculating the voice coil (Step 4). That is to say, the user inputs again to the speaker design support apparatus the command to present the voice coil shape together with the necessary items for designing the vice coil by using the input means 1, and the step of deciding the shape (Step 7) is re-executed.

For instance, when the shape deciding means 51 results in that the bobbin 76 (or the voice coil 71) touches the yoke 74 in the vibration direction of the voice coil 71, the display 3 displays the warning such as "touching to bottom". In this case, after going back to the step of calculating the voice coil (Step 4), the user changes at least a part of necessary items shown in Table 3 for designing the voice coil to input necessary items for designing a new voice coil into the speaker design support apparatus using the input means 1. For example, the user changes only the wire diameter from 0.06 mm to 0.052 mm, as shown in the following Table 7.

TABLE 7

| Description | Unit of quantity | Value |
|---|---|---|
| Nominal diameter | mm | 8 |
| Wire rod name | | Copper wire |

TABLE 7-continued

| Description | Unit of quantity | Value |
|---|---|---|
| Wire diameter | mm | 0.052 |
| Maximum coil diameter | mm | 0.08 |
| Number of layers | Layer(s) | 2 |
| Bobbin material | | Paper |
| Bobbin thickness | μm | 50 |
| Bobbin margin | mm | 0.1 |
| Bobbin height | mm | |
| Gold thread mass | mg | |
| Winding width | mm | |
| Winding number | Turn(s) | |
| Wire length | m | |
| Direct current resistance (DCR) | Ω | |
| Coil mass | mg | |
| Total mass | mg | |
| Max. Voice coil diameter | mm | |
| Voice coil inductance | H | |

Consequently, as shown in the following Table 8, the calculated result by the coil calculation means 22, which the bobbin height is changed from 2.93 mm to 2.29 mm in this case, is obtained.

TABLE 8

| Description | Unit of quantity | Value |
|---|---|---|
| Nominal diameter | mm | 8 |
| Wire rod name | | Copper wire |
| Wire diameter | mm | 0.052 |
| Maximum coil diameter | mm | 0.08 |
| Number of layers | Layer(s) | 2 |
| Bobbin material | | Paper |
| Bobbin thickness | μm | 50 |
| Bobbin margin | mm | 0.1 |
| Bobbin height | mm | 2.29 |
| Gold thread mass | mg | 0.15 |
| Winding width | mm | 1.03 |
| Winding number | Turn(s) | 33 |
| Wire length | m | 0.88 |
| Direct current resistance (DCR) | Ω | 7.13 |
| Coil mass | mg | 18.97 |
| Total mass | mg | 21.5 |
| Max. Voice coil diameter | mm | 8.65 |
| Voice coil inductance | H | 0.0001 |

After this, the shape deciding means 51 re-executes the step of deciding the shape (Step 7). In this case, the shape deciding means 51 obtains the decision result that bobbin 76 (or voice coil 71) does not touch yoke 74 in the vibration direction of voice coil 71. Besides, the step of selecting the pattern (Step 5) and the step of calculating the magnetic circuit (Step 6) may be executed after the step of calculating the voice coil (Step 4). Otherwise, after the step of calculating the voice coil (Step 4), the step of deciding the shape (Step 7) may be executed without executing both the step of selecting the pattern (Step 5) and the step of calculating the magnetic circuit (Step 6). In other words, when the warning is displayed on the display 3 based on the result decided by the shape deciding means 51, after the step of changing at least a part of the necessary items for designing the voice coil, the necessary items for designing the magnet circuit, or both of them, the step of deciding the shape (Step 7) may be executed.

In case where affirmative decision results can be obtained regarding all of the decisions, that effect is displayed on the display 3. And it proceeds to a next step of calculating the magnetic flux density distribution for the magnetic circuit (Step 9). Besides, the steps following to this step are to make arrangements for evaluating the sound pressure frequency characteristic of the speaker and the like, and to calculate and evaluate the frequency characteristic, by means of an equivalent circuit shown in FIG. 6, for example. The equivalent circuit is provided with the relation equivalent to the mutual relation among the voice coil shape and the magnetic circuit shape that are obtained in the steps up to the step of calculating the magnetic circuit (Step 6), and the diaphragm shape and the speaker's acoustic system shape (e.g., a shape of speaker retaining frame) that are obtained separately. The equivalent circuit shown in FIG. 6 may be stored in the storage means 4 as an example of calculating expressions.

In the step of calculating the magnetic flux density distribution (Step 9), magnetic flux density calculation data creating means 61 creates shape data of the voice coil and shape data of the magnetic circuit in the form applicable to a magnetic flux density calculating expression stored in the storage means 4, based on the voice coil shape and the magnetic circuit shape obtained from the respective expressions as above.

Figure 4:
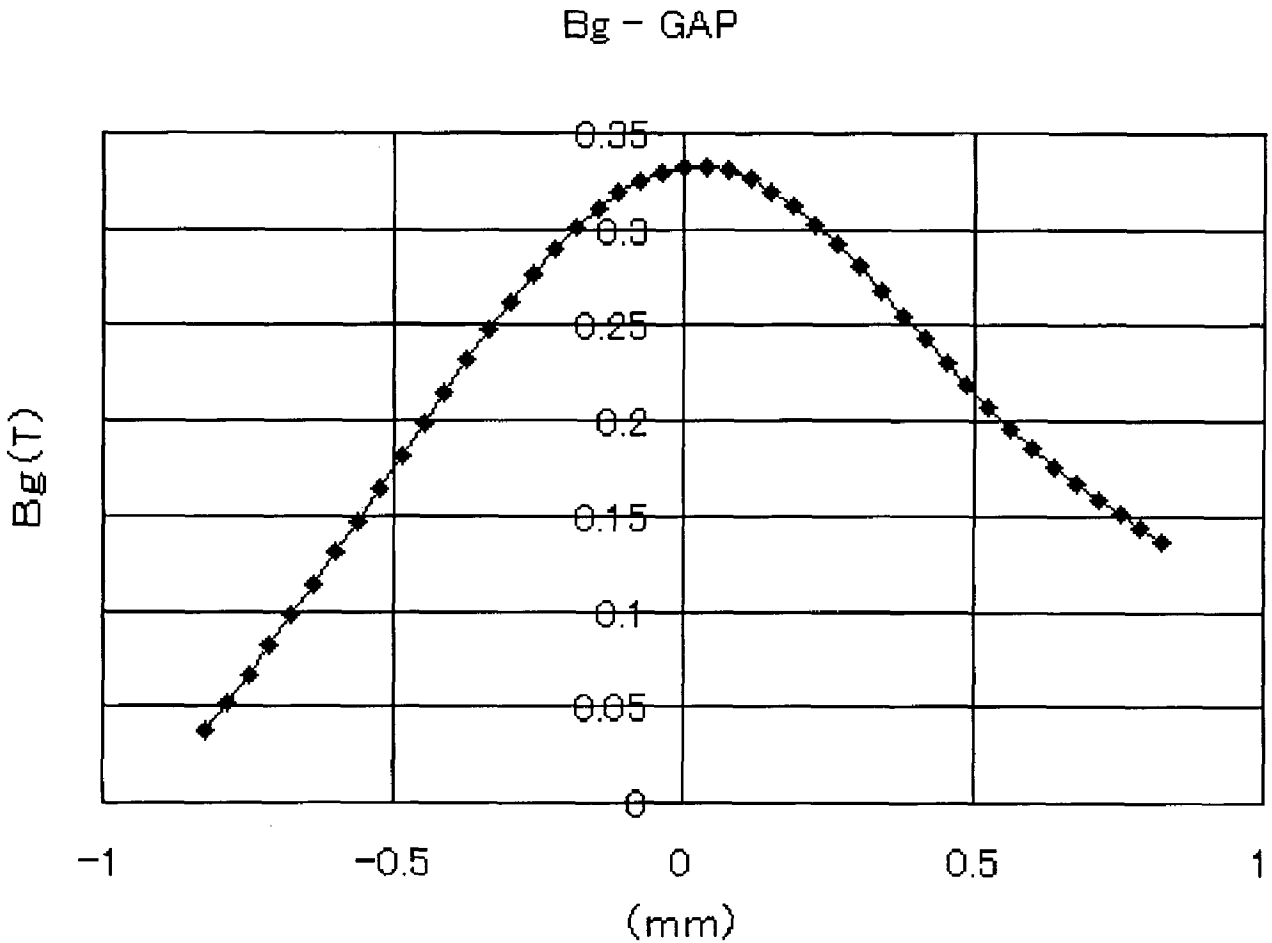
FIG. 4 shows an example of calculated results of the magnetic flux density distribution in embodiments of the present invention.

And so, magnetic flux calculation means 24 performs a computation by substituting the voice coil shape data and the magnetic circuit shape data created by the magnetic flux density calculation data creating means 61 into the magnetic flux calculating expression to obtain the magnetic flux density distribution for the magnetic circuit (Step 9). For example, as shown in FIG. 4, it results in the distribution for the magnetic flux density on the central position (a line L in FIG. 7) in the direction of the thickness of the winding portion of the voice coil. The results are displayed on the display 3. Here, the distribution on the positive side in FIG. 4 illustrates the magnetic flux density on the upper side (the front side of the speaker) over the horizontal surface passing through the middle in the direction of the thickness of the plate 72 (see FIG. 7), in the direction of the thickness of the plate, while the distribution on the negative side illustrates the magnetic flux density on the lower side (the back side of the speaker) below the horizontal surface in the direction of the thickness of the plate 72. In this way, the magnetic flux density can be obtained for each predetermined portion of the magnetic circuit by the calculation of the magnetic flux calculation means 24. For example, it is possible to obtain the magnetic flux density value for a portion A of the plate 72 composing the magnetic circuit, shown in FIG. 8. Additionally, the magnetic flux calculation means 24 obtains the permeance factor from the magnetic flux distribution for the magnet parts obtained by the calculation (Step 9).

Next, force calculation data creating means 62 creates shape data of the voice coil, shape data of the magnetic circuit, and magnetic flux density distribution data that are in the form applicable to a force calculating expression stored in the storage means 4, based on the voice coil shape and the magnetic circuit shape, and the magnetic flux density distribution for the magnetic circuit.

And so, force calculation means 25 performs a calculation by substituting the voice coil shape data, the magnetic circuit shape data, and the magnetic flux density distribution data into the force calculating expression to obtain the force acting on the voice coil (Step 10). The calculated result is displayed on the display 3. As showin in FIG. 5, the result is represented by the relation between the displacement value of the voice coil moving from a statistic position due to the vibration and the factor B1 of the force acting at the central point (point C in FIG. 7) in the direction of the thickness of the winding portion of the voice coil.

Figure 5:
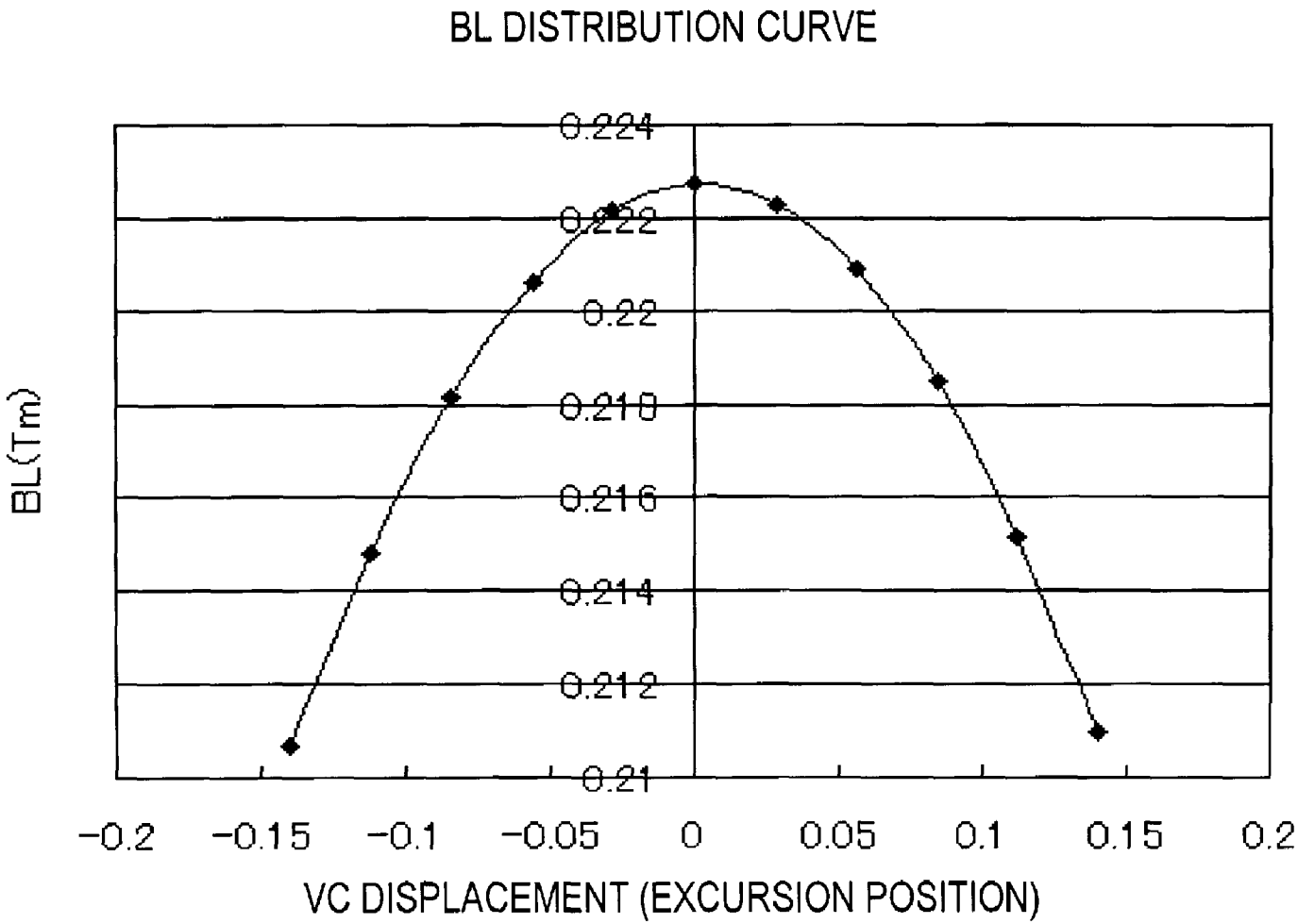
FIG. 5 shows an example of calculated results of the factor of force acting on a voice coil in embodiments of the invention.

Here, the graph on the positive side in FIG. 5 shows the calculated result of the force factor B1 when the voice coil 71 moves to the side of the diaphragm 75 (see FIG. 7), while the graph on the negative side shows the calculated result of the force factor B1 when the voice coil 71 moves to the side of the yoke 74. As shown in FIG. 5, the factor B1 of the force acting on the voice coil changes according to the displacement value of the voice coil moving from the statistic position due to the vibration. This means that the force factor B1 changes periodically along with time if the signal inputted to the voice coil is the periodical alternative current signal. Accordingly, the force calculation means 25 calculates a root-means-square value of the periodic-changing force factor B1 to obtain an effective force factor (Step 11). Here, the effective force factor corresponds to a coupling factor B1 of the equivalent circuit shown in FIG. 6.

Next, the user inputs to the speaker design support apparatus from the input means 1 the data of diaphragm thickness and diaphragm gravity as the necessary items for designing the diaphragm: For example, the data shown in the following Table 9, that is, diaphragm thickness is 30 μm, and diaphragm gravity is 1.3 mg/mm$^3$, are inputted from the input means 1. The contents of Table 9 are displayed on the display 3.

TABLE 9

| Description | Unit of quantity | Value |
|---|---|---|
| Diaphragm thickness | μm | 30 |
| Diaphragm gravity | mg/mm$^3$ | 1.3 |
| Effective diaphragm area | mm$^2$ | |
| Diaphragm mass | mg | |

After this, effective diaphragm area calculation means 26 calculates an effective vibration area Sd from an effective vibration diameter (14.5 mm, see Table 1) of the requirements inputted from the input means (Step 12), and then calculates the diaphragm mass based on the calculated effective vibration area Sd and the data of diaphragm thickness and diaphragm gravity. The effective vibration area Sd and the diaphragm mass calculated by the effective diaphragm area calculation means 26 are displayed on the display 3 together with the data of diaphragm thickness and the data of diaphragm gravity in the form shown in the following Table 10. Here, the effective vibration area Sd corresponds to a coupling factor Sd of the equivalent circuit shown in FIG. 6. And it is not restricted to calculating the effective vibration area Sd and the diaphragm mass after calculating the effective force factor (Step 11). For instance, the calculation of the effective vibration area Sd and the diaphragm mass can be executed after calculating the maximum excursion and so on (Step 3).

TABLE 10

| Description | Unit of quantity | Value |
|---|---|---|
| Diaphragm thickness | μm | 30 |
| Diaphragm gravity | mg/mm$^3$ | 1.3 |
| Effective diaphragm area | mm$^2$ | 165.13 |
| Diaphragm mass | mg | 6.44 |

After that, based on the voice coil shape, the diaphragm mass calculated by the effective diaphragm area calculation means 26, and adhesive information for bonding the voice coil and the diaphragm, effective mass calculation data creating means 63 creates the voice coil shape data, the diaphragm shape data and the adhesive data that are in the form applicable to an effective vibration system mass calculating expression stored in the storage means 4.

And, mass calculation means 27 performs a computaion by substituting the voice coil shape data, the diaphragm shape data, and the adhesive data created by the effective mass calculation data creating means 63 into the effective vibration system mass calculating expression to obtain as an effective vibration system mass Mmd the effective mass of the vibration system of the speaker such as the voice coil (Step 13). And the calculated result is displayed on the display 3. Here, the effective vibration system mass Mmd does not include the acoustic loading mass such as air.

Figure 8:
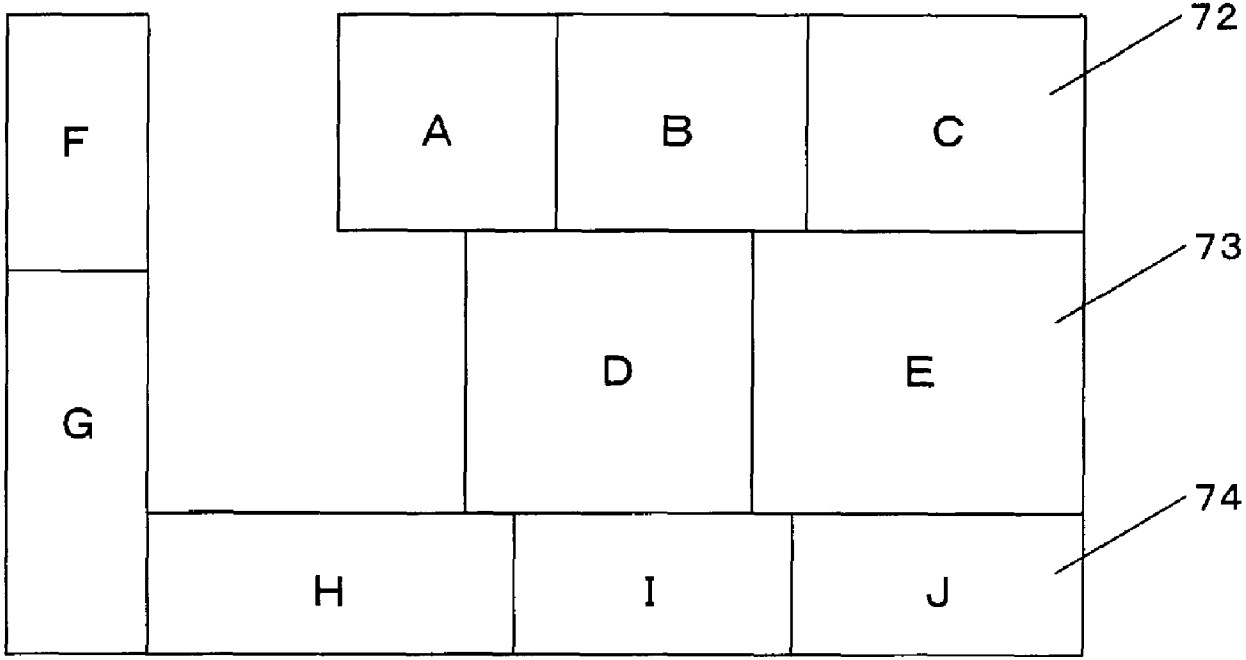
FIG. 8 is a diagram showing blocks of a magnetic circuit.
Figure 9:
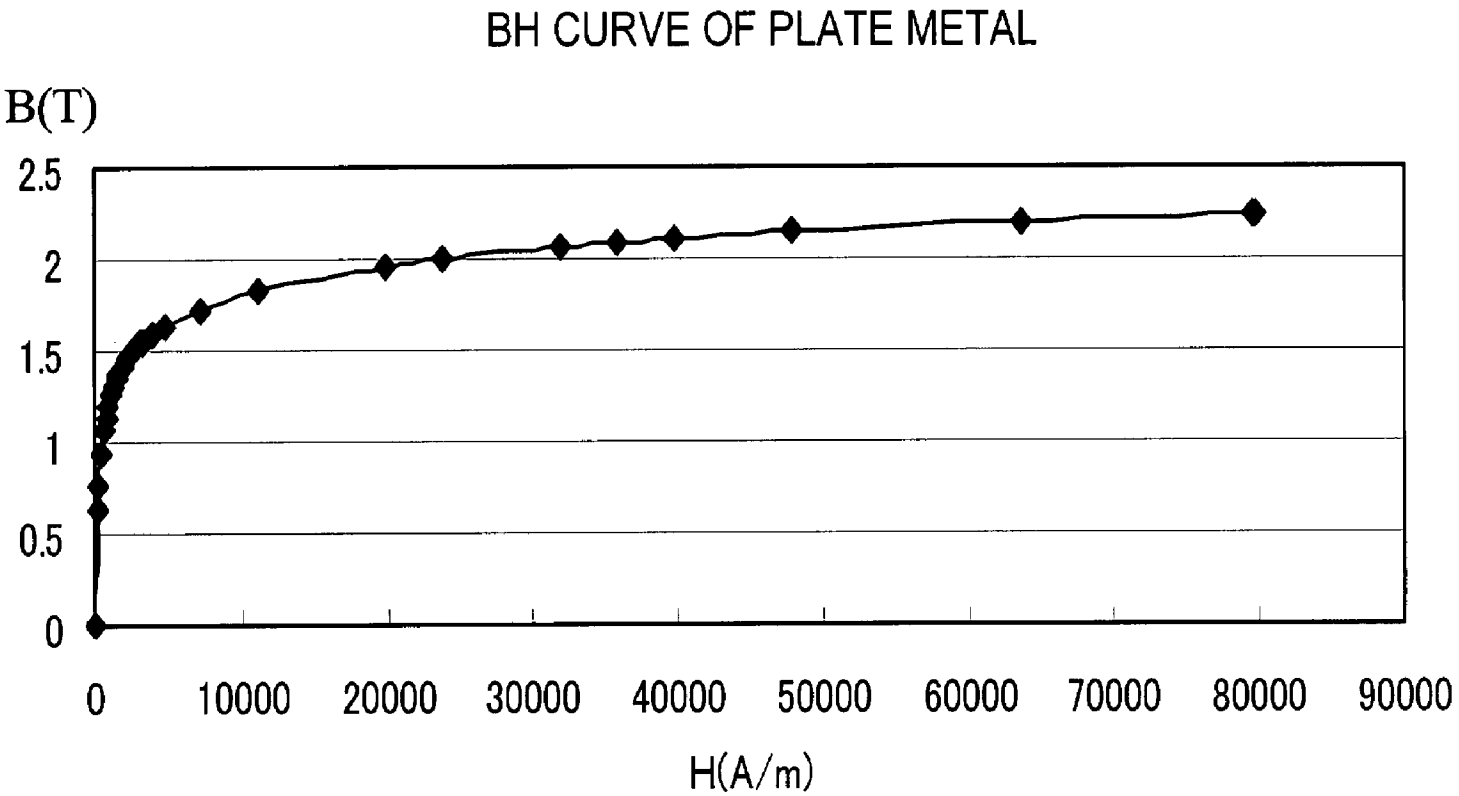
FIG. 9 is a diagram showing data to decide whether the magnetic flux density of each portion of the magnetic circuit is saturated or not.

Next, magnetic circuit characteristic deciding means 52 compares the magnetic flux density for each portion of the magnetic circuit obtained by the magnetic flux calculation means 24 and the data pre-stored in the storage means 4 as shown in FIG. 9 to be a criterion to decide whether the magnetic flux density is saturated or not, and then the decision is executed (Step 14). For instance, it is decided whether the magnetic flux density for the portion A of the plate 72 composing the magnetic circuit shown in FIG. 8 is saturated or not. The magnetic circuit characteristic deciding means 52 decides based on the permeance factor calculated by the magnetic flux calculation means 24 and the permeance factor pre-stored in the storage means 4 whether there is a possibility of occurrence of demagnetization due to the temperature change of the magnet composing the magnetic circuit to be designed (Step 14). The decision result is displayed on the display 3.

At this time, when it is decided that the magnetic flux density is saturated at any portion of the magnetic circuit, or decided that there is a possibility of occurrence of the demagnetization, the warning is displayed on the display 3, and the processing goes back to the step of calculating the voice coil (Step 4). Thereby, the processing goes back again to the step that the user inputs to the speaker design support apparatus from the input means 1 the command to present the voice coil shape together with the necessary items for designing the voice coil, and then the steps up to the step of calculating the effective vibration system mass (Step 13) are re-executed.

When it is decided that the magnetic flux density is saturated at no portion of the magnetic circuit, and decided that there is no possibility of occurrence of the demagnetization, retaining system calculation means 28 performs a computation into a compliance calculating expression stored in the storage means 4 by substituting the minimum resonance frequency Fs of the requirements inputted from the input means 1 and the value Mms based on the effective vibration system mass Mmd calculated by the mass calculation means 27. And, the retaining system calculation means 28 obtains the compliance of the diaphragm edge (the spring constant of the retaining system) Cms by the calculation (Step 15). The calculated result is displayed on the display 3. The compliance calculating expression is represented by the following Expression 6. In Expression 6, the value "Mms" means the effective vibration system mass Mmd added with the acoustic loading mass. And the diaphragm edge compliance Cms is applied to a calculation using the equivalent circuit shown in FIG. 6, which will be described later.

Compliance of diaphragm edge $Cms=1/(Mms\times(2\times\pi\times Fs)^2)$ Expression 6:

Mms: Effective vibration system mass Mmd added with acoustic loading mass

Fs: Minimum resonance frequency

Subsequently, the user inputs data for the acoustic system such as the speaker frame and etc. into the speaker design support apparatus using the input means 1 (Step 16). The acoustic system data may include a frame size, an through-hole shape provided to the frame, an acoustic resistance material shape covering the through-hole, a protector shape provided to the front side of the speaker, and information regarding diaphragm shape which is a corrugated sheet or a flat sheet.

Figure 6:
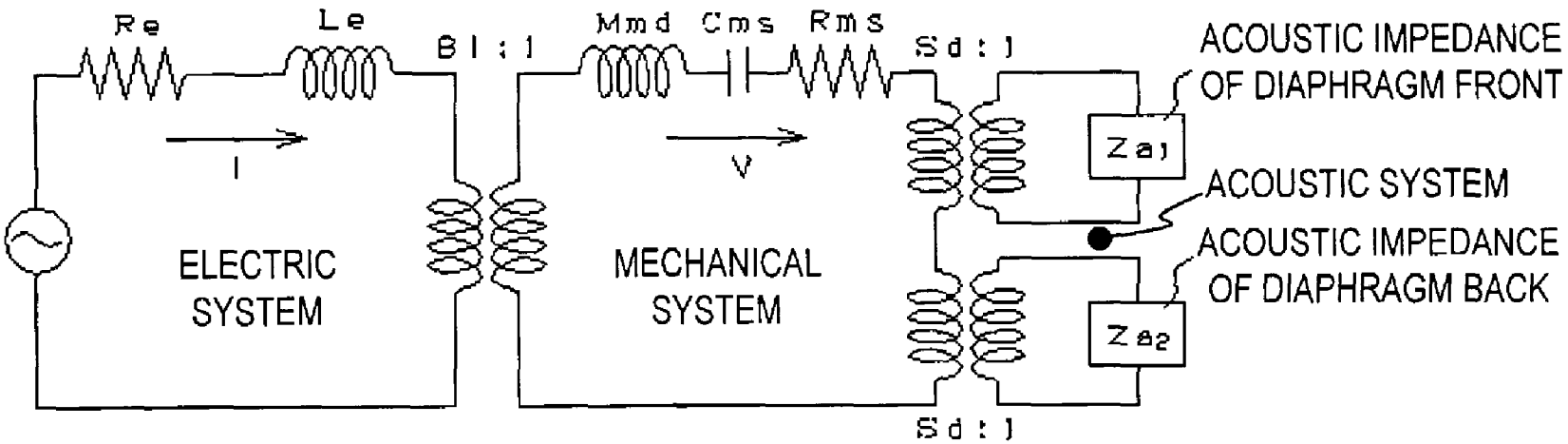
FIG. 6 shows an example of an equivalent circuit for obtaining various frequency characteristic of the speaker in embodiments of the invention.

Based on the acoustic system data, acoustic impedance calculation means 29 calculates acoustic impedance $Z_{a1}$ of the diaphragm front and acoustic impedance $Z_{a2}$ of diaphragm back, of the equivalent circuit shown in FIG. 6.

For instance, when the impedance "$Z_{a1}$" of the equivalent circuit is composed from the resistance, the compliance and the acoustic mass (acoustic inertance), the acoustic impedance calculation means 29 obtains an impedance value for all of the resistance, the compliance and the acoustic mass.

Next, equivalent circuit calculation means 30 calculates a current value I on the corresponding part of the equivalent circuit to the electric system and a velocity value V of the corresponding part of the equivalent circuit to the mechanical system, based on the values obtained by the calulations as the values for respective elements of the equivalent circuit (Step 17). Besides, the Rms value of the equivalent circuit can be a value known from experience for the user using the speaker design support apparatus in the first embodiment, and are inputted by the user from the input means 1. And the current value I and the velocity V can be obtained by solving the equivalent circuit in consideration of the correlation between the induced electromotive force and the counter electromotive force.

Various frequency characteristic calculation means 31 peforms a computation by substituting the velocity V obtained by the equivalent circuit calculation means 30 into the following Expression 7 to obtain the excursion frequency characteristic of the diaphragm composing the speaker (Step 18). Furthermore, the various frequency characteristic calculation means 31 adds a specific value to the maximum excursion of the calculated excursion frequency characteristic of the diaphragm, and calculates the excursion margin (Step 19). And the various frequency characteristic calculation means 31 performs a computaion by substituting the current value I obtained by the equivalent circuit calculation means 30 into the following Expression 8 to obtain the impedance frequency characteristic of the speaker (Step 20).

Excursion frequency characteristic $X=V/(j\omega)$ Expression 7:

Impedance frequency characteristic $Z=E/I$ Expression 8:

And the various frequency characteristic calculation means 31 obtains, as the sound pressure frequency characteristic of the diaphragm front, a voltage value across a predetermined element of $Z_{a1}$, e.g., the compliance, of the equivalent circuit in FIG. 6 (Step 21). Likewise, the various frequency characteristic calculation means 31 obtains, as the sound pressure frequency characteristic of the diaphragm back, a voltage value of both ends of a predetermined element of $Z_{a2}$, e.g., the compliance, of the equivalent circuit (Step 21). Here, the predetermined element is decided according to the place that the speaker designed by the speaker design support apparatus in the present embodiment is fixed on.

Final deciding means 53 decides whether the sound pressure frequency characteristic obtained by the various frequency characteristic calculation means 31 satisfies the target SPL (target sound pressure) of the above requirements (Step 22). In addition, the final deciding means 53 decides whether the speaker thickness decided based on the excursion frequency characteristic obtained by the various frequency characteristic calculation means 31 meets the requirement for thickness (Step 22). These decision results are displayed on the display 3.

At this time, if respective calculated results do not meet the requirements, the warning is displayed on the display 3 (Step 23). Thereby, the procedure goes back to the step of calculating the voice coil (Step 4) or the step of inputting the acoustic system shape (Step 16), and then re-executes the subsequent steps. If the sound pressure value obtained by the above calculation is lower than the target SPL (target sound pressure level), the procedure goes back to the step of calculating in order to reduce the mass of the voice coil (Step 4), because a decrease in effective mass of the vibration system results in an increase in sound pressure. And, when the speaker thickness decided based on the diaphragm excursion frequency characteristic obtained by the above calculation is larger than the target thickness, it goes back to the step of inputting data in order to increase the through-hole diameter (Step 16), because an increase in diameter of the through-hole provided to the frame allows a decrease in excursion of the diaphragm, furthermore in thickness of the speaker.

In case where it is decided that the calculated results meet the requirements, that effect is displayed on the display 3, before the designing of the speaker is completed. And the design specification is printed out (Step 24). Here, the design specification includes the speaker impedance characteristic obtained by the various frequency characteristic calculating means 31. The impedance characteristic becomes a clue to know a Q-value of the speaker.

As described above, by using the speaker design support apparatus in this embodiment, it is possible to finish a design of a speaker with less frequency of designing a speaker, and it makes possible to design the speaker meeting predetermined requirements in a short time.

Besides, in the abovementioned first embodiment, the equivalent circuit shown in FIG. 6 is applied as an example of the sound pressure calculating expression, the diaphragm excursion calculating expression, and the impedance calculating expression, however, the present invention may adopt a plurality of equivalent circuits. For instance, the equivalent circuits are for considering various corrections for the acoustic system circuits. And it may be also arranged that the user select either one of plural equivalent circuits.

In the abovementioned first embodiment, the speaker design support apparatus is provided with the magnetic circuit characteristic deciding means 52, and the magnetic circuit characteristic deciding means 52 decides whether the magnetic flux density for each portion of the magnetic circuit obtained by the magnetic flux calculation means 24 is saturated or not. And the magnetic circuit characteristic deciding means 52 decides whether there is a possibility of the occurrence of demagnetization due to the temperature change of the magnet composing the magnetic circuit to be designed. However, the invention is not limited that the speaker design support apparatus is provided with the magnetic circuit characteristic deciding means 52. In case where the magnetic circuit characteristic deciding means 52 is not provided to the speaker design support apparatus, the user may perform the decision instead of the magnetic circuit characteristic deciding means 52. Otherwise, the user may perform either one of two decision items; whether the magnetic flux density per portion of the magnetic circuit is saturated or not; and whether there is a possibility of the occurrence of demagnetization due to the temperature change of the magnet according to the permeance factor, and the other item may be decided by the magnet circuit characteristic deciding means 52.

In addition, the magnetic flux density calculation means 24, the acoustic impedance calculation means 29, the equivalent circuit calculation means 30 and the various frequency characteristic calculation means 31 in the present embodiment can be wholly or partly accomplished by the computing unit that performs a computation with software.

Second Embodiment

The following explains about the configuration and operations of the speaker design support apparatus in the second embodiment according to attached drawings.

Figure 10:
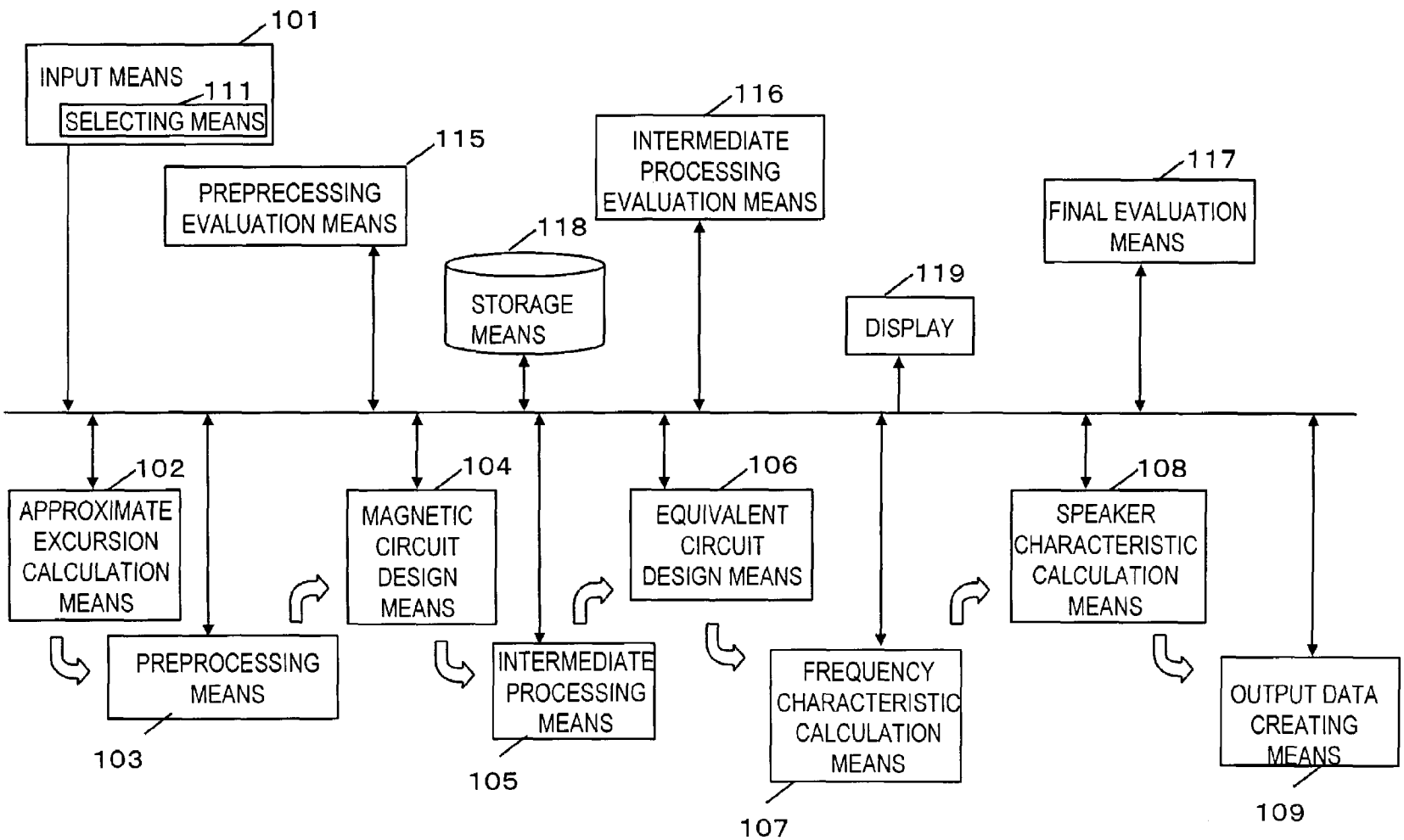
FIG. 10 is a block diagram of a speaker support apparatus in the second embodiment.
Figure 11:
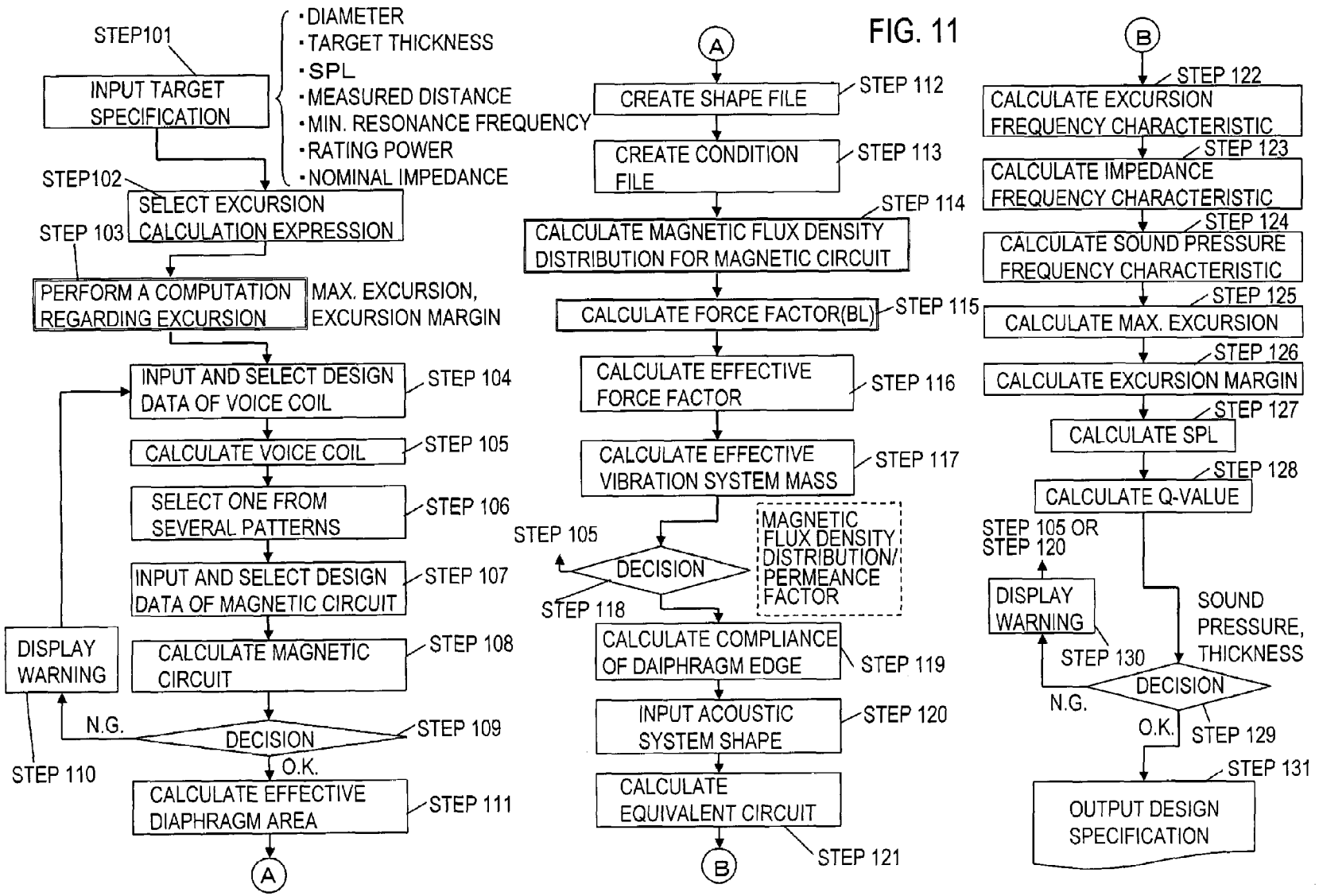
FIG. 11 is a diagram explaining an operation of the speaker support apparatus in the second embodiment.
Figure 12:
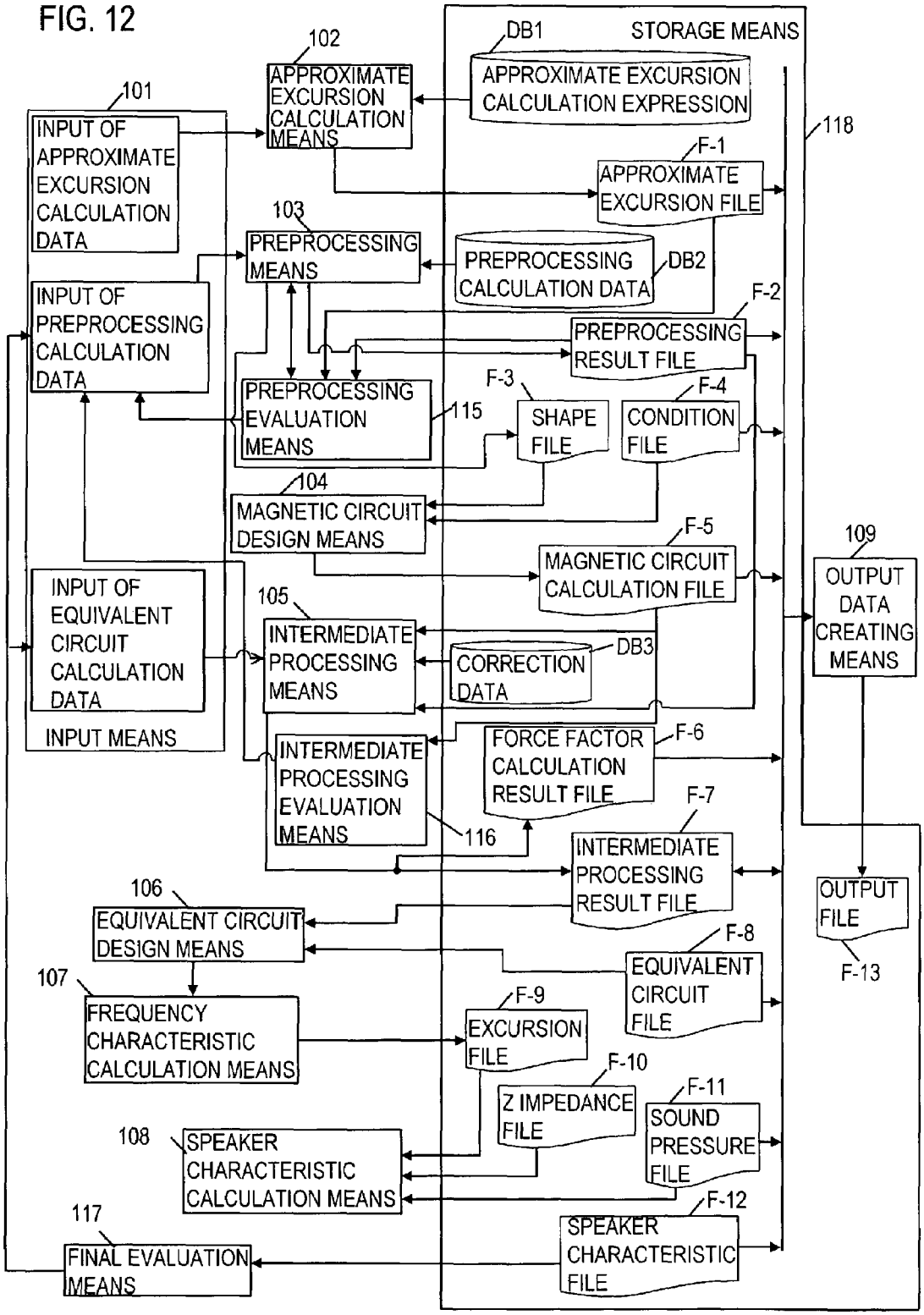
FIG. 12 is a diagram showing the outline processing of the speaker support apparatus in the second embodiment.

FIG. 10 shows a schematic configuration of the speaker design support apparatus in the second embodiment. FIG. 11 shows an operating procedure of the speaker design support apparatus in the second embodiment. FIG. 12 shows the outline of operations executed by the speaker design support apparatus in the second embodiment.

As shown in FIG. 10, the speaker design support apparatus of this second embodiment comprises input means 101, approximate excursion calculation means 102, preprocessing means 103, magnetic circuit design means 104, intermediate processing means 105, equivalent circuit design means 106, frequency characteristic calculation means 107, speaker characteristic calculation means 108, output data creating means 109, preprocessing evaluation means 115, intermediate processing evaluation means 116, final evaluation means 117, storage means 118, and display 119.

A user of the speaker design support apparatus in the second embodiment inputs to the speaker design support apparatus various requirements for a speaker presented by the mobile phone maker, by means of the input means 101 composed from a keyboard and the like. The requirements such as a diameter, a target thickness, a target SPL (target sound pressure), a measured distance (distance between the speaker and means for detecting sound from the speaker), a minimum resonance frequency Fs, a rating power, nominal impedance, and an effective vibration diameter, are inputted (Step 101 in FIG. 11). Specifically, the user inputs the requirements as shown in the following Table 11, that is, 22 mm as diameter, 5 mm as target thickness, 82 dB as target SPL, 1 m as measured distance, 800 Hz as minimum resonance frequency Fs, 0.5 W as rating power, 8Ω as nominal impedance, and 14.5 mm as effective vibration diameter, by means of the input means 101. And the contents of the Table 11 inputted from the input means 101 are displayed on the display 119.

TABLE 11

| Description | Unit of quantity | Value |
|---|---|---|
| Diameter | mm | 22 |
| Target thickness | mm | 5 |
| Target SPL | dB | 82 |
| Measured distance | m | 1 |
| Min. resonance frequency | Hz | 800 |
| Rating power | W | 0.5 |
| Nominal impedance | Ω | 8 |
| Effective vibration diameter | mm | 14.5 |
| Max. Excursion | mm | |
| Excursion margin | mm | |

As described in the first embodiment, if it is possible to obtain approximate values of the maximum excursion and the excursion margin for the diaphragm composing the speaker, the user can decide approximately whether the diaphragm touches the protector of the speaker and whether the voice coil vibrating with the diaphragm touches the magnetic circuit. Therefore, the speaker design support apparatus in the second embodiment is arranged so as to execute first an approximate excursion calculation for obtaining the maximum excursion and the excursion margin of the diaphragm composing the speaker. The approximate excursion calculation is explained hereinafter.

After the above requirements are inputted, the display 119 displays two approximate-excursion calculating expressions represented by Expressions 1 and 2 out of the approximate excursion calculating expression database DB1 (see FIG. 12) stored in the storage means 118. Those two expressions were explained in the first embodiment, and Expression 1 is for obtaining a maximum excursion and an excursion margin of the standard design, and Expression 2 is for obtaining a maximum excursion and an excursion margin of the worst-case design.

$$\text{Max.Excursion}(X\text{max1})=v/j\omega$$

$$\text{Excursion Margin}(X\text{mgn1})=X\text{max1}\times\text{Safety Factor}$$

$$v=2\times r\times p/(\rho_0\times\omega\times a^2) \qquad \text{Expression 1:}$$

r: Distance between a speaker and means for detecting sound from the speaker $p=10^{(SPL/20)}\times 2\times 10^{-5}$ $\rho_0$: Air density $\omega=2\times\pi\times fs$ fs: Frequency a=Effective vibration diameter/2

$$\text{Max. Excursion}(X\text{max2})=v_2/(j\omega\times\text{Safety factor})$$

$$\text{Excursion Margin}(X\text{mgn2})=X\text{max2}+\text{Component Assembly Tolerance}$$

$$v_2=2\times r\times p/(\rho_0\times\omega\times\text{Safety Factor}\times a^2) \qquad \text{Expression 2:}$$

r: Distance between a speaker and means for detecting sound from the speaker $p=10^{(SPL/20)}\times 2\times 10^{-5}$ $\rho_0$: Air density $\omega=2\times\pi\times fs$ fs: Frequency a=Effective vibration diameter/2

After the display 119 displays the two approximate-excursion calculating expressions such as the above Expressions 1 and 2, if the user wants to know the maximum excursion and the excursion margin of standard design, he or she selects Expression 1 by means of selecting means 111 (Step 102). Or, if he wants to know the maximum excursion and excursion margin of worst-case design, he or she selects Expression 2 by means of the selecting means 111 (Step 102). After Expression 1 or 2 is selected, the approximate excursion calculation means 102 obtains approximate values of the maximum excursion and the excursion margin of the diaphragm by using data necessary for the approximate excursion calculation out of the data inputted from the input means 101 and the selected Expression 1 or 2 (Step 103). The calculated result is displayed on the display 119 together with the requirements. For instance, when Expression 1 is selected, it can be obtained calculated results shown in table 12, that is, the maximum excursion is 0.45 mm and the excursion margin is 0.69 mm, and such results are displayed on the display 119. The calculated result (the contents of table 12) is stored in an approximate excursion file F-1 on the storage means 118.

TABLE 12

| Description | Unit of quantity | Value |
|---|---|---|
| Diameter | mm | 22 |
| Target thickness | mm | 5 |

TABLE 12-continued

| Description | Unit of quantity | Value |
|---|---|---|
| Target SPL | dB | 82 |
| Measured distance | m | 1 |
| Min. resonance frequency Fs | Hz | 800 |
| Rating power | W | 0.5 |
| Nominal impedance | Ω | 8 |
| Effective vibration diameter | mm | 14.5 |
| Max. Excursion | mm | 0.45 |
| Excursion margin | mm | 0.69 |

Here, the user may select both of Expression 1 and 2. Thereby, both values of the standard design and the worst-case design are displayed on the display 119.

If the approximate values of maximum excursion and excursion margin of the diaphragm is obtained as described above, the user can decide approximately whether the diaphragm touches the protector of the speaker, and whether the voice coil vibrating with the diaphragm touches the magnetic circuit.

Next, in the speaker design support apparatus of the second embodiment the preprocessing means 103 performs the following calculation for creating data to obtain the magnetic flux density distribution and so on of the magnetic circuit composing the speaker.

First, the user inputs to the speaker design support apparatus the command to present a shape (size, for example) of the voice coil composing the speaker together with some of necessary items to design the voice coil by means of the input means 101 (Step 104). And the user selects the remainder of the necessary items to design the voice coil out of the preprocessing calculation database DB2 (see FIG. 12) stored in the storage means 118 by means of the selecting means 111 of the input means 101 (Step 104).

For instance, the user selects as a nominal diameter either one of "10 mm", "11 mm", "12 mm", and . . . of the preprocessing calculation database DB2 stored in the storage means 118, as shown in Table 13. By the selection of the nominal diameter, the values of the other items described on the same line as the selected nominal diameter are also selected. For instance, when the user selects "10 mm" as a nominal diameter, 10.5 mm is selected as an actual diameter of the voice coil (bobbin bore), 0.1 mm as a bore tolerance. And likewise, 9.5 mm is selected as a diameter of the plate composing the magnetic circuit; 12.0 mm is as a bore of the yoke composing the magnetic circuit; 4.0 mg is as mass of an adhesive for bonding the voice oil and the diaphragm. For convenience, assuming that the user selects "10 mm" as the nominal diameter, this embodiment is explained. Here, the nominal diameter is an approximate value of the diameter of the voice coil.

TABLE 13

Nominal diameter DB

| Nominal diameter (mm) | Bobbin bore (mm) | Bore tolerance (mm) | Plate diameter (mm) | Yoke bore (mm) | Adhesives mass (mg) |
|---|---|---|---|---|---|
| ϕ 10 | 10.5 | 0.1 | 9.5 | 12.0 | 4.0 |
| ϕ 11 | 11.5 | 0.1 | 10.5 | 13.0 | 5.0 |
| ϕ 12 | 12.5 | 0.1 | 11.5 | 14.0 | 6.0 |
| . | . | . | . | . | . |
| . | . | . | . | . | . |
| . | . | . | . | . | . |

The user selects as a wire rod name either one of "copper wire 1", "copper wire 2", "copper wire 3", and . . . of the preprocessing calculation database DB2 stored in the storage means 118, as shown in Table 14. By the selection of the wire rod name, the values of the other items described on the same line as the selected wire rod name are also selected. For instance, when the user selects "copper wire 2" as a wire rod name, 0.060 mm is selected as a wire diameter, 0.065 mm as a maximum coil diameter. And likewise, 35.0 is selected as resistivity, and 0.02 is as a mass ratio, simultaneously. For convenience, assuming that the user selects copper wire 2 as the wire rod name, this embodiment is explained.

TABLE 14

Wire rod DB

| Wire rod name | Wire diameter (mm) | Max. Coil diameter (mm) | Resistivity | Mass ratio |
|---|---|---|---|---|
| Copper wire 1 | 0.050 | 0.055 | 40.5 | 0.01 |
| Copper wire 2 | 0.060 | 0.065 | 35.0 | 0.02 |
| Copper wire 3 | 0.070 | 0.075 | 30.0 | 0.03 |
| . | . | . | . | . |
| . | . | . | . | . |
| . | . | . | . | . |

The user selects as a bobbin material name either one of "bobbin-less", "resin 1", "metal 1", and . . . of the preprocessing calculation database DB2 stored in the storage means 118, as shown in Table 15. By the selection of the bobbin material name, the values of the other items described on the same line as the selected bobbin material name are also selected. For instance, when the user selects "resin 1" as the bobbin material name, "0.5" as the gravity described on the same line as "resin 1" is also selected, as shown in Table 15. For convenience, assuming that the user selects "resin 1" as the bobbin material name, this embodiment is explained. Besides, the meaning of "bobbin-less" in the column of the bobbin material name in Table 15 is a case where the diaphragm and the voice coil are bonded directly without using the bobbin.

TABLE 15

Bobbin material DB

| Bobbin material name | Gravity |
|---|---|
| Bobbin-less | 0 |
| Resin 1 | 0.5 |
| Metal 1 | 3 |
| . | . |
| . | . |
| . | . |

And as some of necessary items for designing the voice coil respective data, the user inputs from the input means 101 such items that the number of layers is 2, the bobbin thickness is 50 μm, and the bobbin margin is 0.1 mm.

The contents thus selected and inputted by user as above are displayed on the display 119 as shown in Table 16.

TABLE 16

| Description | Unit of quantity | Value |
|---|---|---|
| Nominal diameter | mm | 8 |
| Wire rod name | | Copper wire |
| Wire diameter | mm | 0.06 |
| Maximum coil diameter | mm | 0.08 |
| Number of layers | Layer(s) | 2 |
| Bobbin material | | Paper |
| Bobbin thickness | μm | 50 |

TABLE 16-continued

| Description | Unit of quantity | Value |
|---|---|---|
| Bobbin margin | mm | 0.1 |
| Bobbin height | mm | 2.93 |
| Gold thread mass | mg | 0.2 |
| Winding width | mm | 1.84 |
| Winding number | Turn(s) | 45 |
| Wire length | m | 1.21 |
| Direct current resistance (DCR) | Ω | 7.32 |
| Coil mass | mg | 34.1 |
| Total mass | mg | 37.34 |
| Max. Voice coil diameter | mm | 8.69 |
| Voice coil inductance | H | |

And the preprocessing means 103 performs a computation by substituting necessary data inputted from the input means 101 for calculating the voice coil shape selected from the preprocessing calculation database DB2 into a respective plurality of coil calculating expressions stored in the storage means 118, with the result that the voice coil shape is obtained (Step 105).

The coil calculating expressions are shown as the following Expressions 3 and 4, for example. Expression 3 of those two coil calculating expressions is to obtain a bobbin height (Hvc) as an example of the voice coil shape, and Expression 4 is to obtain a winding width (Wvc). Here, those expressions 3 and 4 are the same as in the first embodiment.

$$\text{BobbinHeight}(Hvc)=\text{Max.Excursion}(X\text{max}1)\times\text{Safety-Factor}\times\text{Winding width}(Wvc)+\text{bobbin Margin}(Hhs) \quad \text{Expression 3:}$$

$$\text{Winding width}(Wvc)=\text{Max.Coil Diameter}(Dw\text{max})\times\text{Winding Number of First Layer} \quad \text{Expression 4:}$$

In this case, the preprocessing means 103 obtains the calculated result that, as an example of the voice coil shape, the bobbin height (Hvc) and the winding width (Wvc) are 3.0 mm and 2.0 mm respectively, and then those are displayed on the display 119.

And now, the user can input plural patterns of necessary items for designing the voice coil and compare respective results calculated based on the plural patterns. In a case of calculating the bobbin height (Hvc) and the winding width (Wvc), three patterns of the items are inputted in total by selecting "copper wire 1" as well as "copper wire 2" shown in Table 14 as the wire rod name, and also selecting values of the winding number of the first layer and the bobbin margin (Hbs) except the above. At this time, the display 119 displays the results of the bobbin height (Hvc) and the winding width (Wvc) calculated every pattern. Hereupon, the user selects either one of three patterns by means of the selecting means 111 (Step 106), and the shape of voice coil (an example of shape) is decided. For convenience, assuming that the user selects the contents shown in Table 16, this embodiment is explained.

In addition, according to the data that "the nominal diameter is 10 mm, the wire rod name is copper wire 2, the wire diameter is 0.060 mm, the maximum coil diameter is 0.065 mm, the number of layers is 2", the preprocessing means 103 obtains such calculated results that the direct current resistance (DCR) Re is 8.5Ω and the inductance Le is 0.0001 H. Each value of the direct current resistance and the inductance Le is displayed on the display 119. And each value of the direct current resistance and the inductance Le is used as a resistance value of a specific electric element and an inductance value of the coil on the after-mentioned equivalent circuit (See FIG. 6). Here, the equivalent circuit shown in FIG. 6 is stored in an equivalent circuit file F-8 of the storage means 118 shown in FIG. 12.

Based on the necessary data for calculating the voice coil shape data inputted and selected by the user, the preprocessing means 103 also obtains such calculated results that the gold thread mass is 0.2 mg, the winding number is 45turns, the wire length is 1.2 m, the coil mass is 34 mg, and the total mass is 37 mg, and the maximum diameter of voice coil is 8.7 mm.

The results thus calculated by the preprocessing means are displayed on the display 119 in the form shown in Table 17 together with the necessary items for designing the voice coil inputted or selected by the user. The calculated results shown in Table 17 are stored in a preprocessing result file F-2 of the storage means 118 (see FIG. 12).

TABLE 17

| Description | Unit of quantity | Value |
|---|---|---|
| Nominal diameter | mm | 8 |
| Wire rod name | | Copper wire |
| Wire diameter | mm | 0.06 |
| Maximum coil diameter | mm | 0.08 |
| Number of layers | Layer(s) | 2 |
| Bobbin material | | Paper |
| Bobbin thickness | μm | 50 |
| Bobbin margin | mm | 0.1 |
| Bobbin height | mm | 2.93 |
| Gold thread mass | mg | 0.2 |
| Winding width | mm | 1.84 |
| Winding number | Turn(s) | 45 |
| Wire length | m | 1.21 |
| Direct current resistance (DCR) | Ω | 7.32 |
| Coil mass | mg | 34.1 |
| Total mass | mg | 37.34 |
| Max. Voice coil diameter | mm | 8.69 |
| Voice coil inductance | H | |

Next, the user inputs to the speaker design support apparatus the command to present a size (an example of shape) of the magnetic circuit composing the speaker together with some of necessary items for designing the magnetic circuit using the input means 101 (Step 107). And the user selects the remainder of the necessary items for designing the magnetic circuit from the preprocessing calculation database DB2 (see FIG. 12) stored in the storage means 118 with the selecting means 111 of the input means 101 (Step 107).

For instance, the user inputs from the input means 101 such data shown in Table 18 that a plate diameter is 7.9 mm, a plate thickness is 0.5 mm, a magnet diameter is 7.4 mm, a magnet thickness is 1.2 mm, a yoke bore is 9 mm, and a yoke thickness is 0.6 mm; those data as an example of the necessary items for designing the magnetic circuit.

TABLE 18

| Description | Unit of quantity | Value |
|---|---|---|
| Plate diameter | mm | 7.9 |
| Plate thickness | mm | 0.5 |
| Magnet diameter | mm | 7.4 |
| Magnet thickness | mm | 1.2 |
| Magnet material | | Neodymium (BHmax = 35) |
| Yoke bore | mm | 9 |
| Yoke thickness | mm | 0.6 |
| Yoke height | mm | 2.3 |

The user selects either one of "metal 1", "metal 2", and . . . that are shown in Table 19 as plate and yoke material names on the preprocessing calculation database DB2 stored in the storage means 118. For convenience, assuming that the user selects "metal 1" as the plate and yoke material names, this embodiment is explained. Here, the magnetic flux density (B) and the magnetic field intensity (H) are for specifying the physical properties of plate and yoke materials.

TABLE 19

| Material name | Magnetic flux density (B) | Magnetic field intensity (H) |
|---|---|---|
| Metal 1 | 240.0 | 0.6 |
| | 320.0 | 0.8 |
| | 330.0 | 0.9 |
| | . | . |
| | . | . |
| | . | . |
| Material 2 | 495.0 | 0.6 |
| . | . | . |
| . | . | . |
| . | . | . |

In addition, the user selects either one of "magnet 1", "magnet 2", and . . . that are shown in Table 20 as a magnet material name on the preprocessing calculation database DB2 stored in the storage means 118. For convenience, assuming that the user selects "magnet 1" as the magnet material name, this embodiment is explained. Here, the magnetic flux density (B) and the magnetic field intensity (H) are defined in the same way as Table 19.

TABLE 20

| Magnetic material name | Magnetic flux density (B) | Magnetic field (H) |
|---|---|---|
| Magnet 1 | −10000 | 0 |
| | 0 | 1 |
| Magnet 2 | −20000 | 0 |
| | 0 | 2 |
| . | . | |
| . | . | |
| . | . | |

The contents of the necessary items for designing the magnetic circuit inputted and selected by the user as above are displayed on the display 119 in the form shown as Table 21.

TABLE 21

| Description | Unit of quantity | Value |
|---|---|---|
| Plate diameter | mm | 7.9 |
| Plate thickness | mm | 0.5 |
| Plate material | | Metal 1 |
| Magnet diameter | mm | 7.4 |
| Magnet thickness | mm | 1.2 |
| Magnet material | | Magnet 1 |
| Yoke bore | mm | 9 |
| Yoke thickness | mm | 0.6 |
| Yoke height | mm | |
| Yoke material | | Metal 1 |

Subsequently, the preprocessing means 103 peforms a computation by substituting necessary data inputted from the input means 101 for calculating the size of the magnetic circuit and data selected from the preprocessing calculation database DB2 for calculating the shape of the magnetic circuit into a magnetic circuit calculating expression stored in the storage means 118 to obtain the size of magnetic circuit (Step 108).

The magnetic circuit calculating expression is represented by the following Expression 5, for example, and the expression is for obtaining the yoke height (Hy).

$$\text{YokeHeight}(Hy)=\text{PlateThickness}(Tp)+\text{MagnetThickness}(Tm)+\text{YokeThickness}(Ty) \quad \text{Expression 5:}$$

The yoke height (Hy) obtained according to Expression 5 by the preprocessing means 103 is displayed on the display 119 in the form shown in Table 22, together with the necessary items inputted or selected by the user for designing the magnetic circuit. And the calculated result shown in Table 22 is stored in the preprocessing result file F-2 (See FIG. 12) of the storage means 118.

TABLE 22

| Description | Unit of quantity | Value |
|---|---|---|
| Plate diameter | mm | 7.9 |
| Plate thickness | mm | 0.5 |
| Plate material | | Metal 1 |
| Magnet diameter | mm | 7.4 |
| Magnet thickness | mm | 1.2 |
| Magnet material | | Magnet 1 |
| Yoke bore | mm | 9 |
| Yoke thickness | mm | 0.6 |
| Yoke height | mm | 2.3 |
| Yoke material | | Metal 1 |

Next, preprocessing evaluation means 115 performs a after-mentioned deciding process regarding five decision items based on the maximum excursion and the excursion margin of the diaphragm obtained by the approximate excursion calculation means 102, the voice coil shape (size) and the magnetic circuit shape (size) obtained by the progressing means 103 (Step 109).

The deciding process is explained according to FIG. 7. In the first place, the preprocessing evaluation means 115 decides whether the diaphragm body 751 touches the plate 72 composing the magnetic circuit when the diaphragm 75 vibrates along with the vibration of the voice coil 71. That is to say, it is decided whether a distance D1 between the plate 72 and the diaphragm 751, shown in FIG. 7, can be kept within the range that the plate 72 does not touch the diaphragm body 751 when the diaphragm 75 vibrates.

In the second place, when the diaphragm 75 vibrates together with the vibration of the voice coil 71, the preprocessing evaluation means 115 decides whether the diaphragm edge 752 touches the yoke 74. That is to say, it is decided whether a distance D2 between the diaphragm edge 752 and the yoke 74, shown in FIG. 7, can be kept within the range that the diaphragm edge 752 does not touch the yoke 74 when the diaphragm 75 vibrates.

In the third place, when the voice coil 71 vibrates, the preprocessing evaluation means 115 decides whether the bobbin 76 touches the yoke 74 in the vibration direction of the voice coil 71. That is to say, it is decided whether a distance D3 between the bobbin 76 and the yoke 74, shown in FIG. 7, can be kept within the range that the bobbin 76 does not touch the yoke 74 when the voice coil 71 vibrates. Besides, the above explains about the deciding process in a case where the bobbin 76 is proved to the voice coil 71. However, in case where the voice coil 71 is not provided with the bobbin 76, the preprocessing evaluation means 115 decides whether the voice coil 71 touches the yoke 74 in the vibration direction of the voice coil 71 when the voice coil 71 vibrates, In the fourth place, the preprocessing evaluation means 115 decides whether the voice coil 71 touches the yoke 74 in the direction perpendicular to the vibration direction of voice coil 71. That is to say, it is decided whether a distance D4 between the voice coil 71 and the yoke 74, shown in FIG. 7, can be kept within the range that the voice coil 71 and the yoke 74 does not touches each other.

Additionally, in the fifth place, though the speaker shown in FIG. 7 is provided with the bobbin 76, the preprocessing evaluation means 115 decides whether the bobbin 76 is required or not to connect the voice coil 71 and the diaphragm 75.

Those deciding results by the preprocessing evaluation means 115 are displayed on the display 119. At this time, if any one of the five decision items 1 to 5 results in a negative decision, it is decided that the speaker shape is out of the limited range. The warning is displayed on the display 119 (Step 110). In this case, the user inputs again to the speaker design support apparatus the request to present the voice coil shape together with the necessary items for designing the vice coil by means of the input means 1 (Step 104), and the step of deciding the shape is re-executed (Step 109).

For instance, when the preprocessing evaluation means 115 decides that the bobbin 76 (or the voice coil 71) touches the yoke 74 in the vibration direction of the voice coil 71, the display 119 displays a warning such as "touching at bottom". In this case, the user changes at least a part of necessary items for designing the voice coil shown in Table 16 to input new necessary items for designing voice coil into the speaker design support apparatus by means of the input means 101. For example, "copper wire 1" is selected over again as the wire rod name and the wire diameter is changed from 0.06 mm to 0.052 mm, as shown in the following Table 23.

TABLE 23

| Description | Unit of quantity | Value |
|---|---|---|
| Nominal diameter | mm | 10 |
| Wire rod name | | Copper wire 1 |
| Wire diameter | mm | 0.050 |
| Maximum coil diameter | mm | 0.055 |
| Number of layers | Layer(s) | 2 |
| Bobbin material | | Resin 1 |
| Bobbin thickness | μm | 50 |
| Bobbin margin | mm | 0.1 |
| Bobbin height | mm | |
| Gold thread mass | mg | |
| Winding width | mm | |
| Winding number | Turn(s) | |
| Wire length | m | |
| Direct current resistance (DCR) | Ω | |
| Coil mass | mg | |
| Total mass | mg | |
| Max. Voice coil diameter | mm | |
| Voice coil inductance | H | |

After the part of data is changed, it results as shown in the following Table 24 that the height of bobbin is changed from 3.00 mm to 2.5 mm by the processing means 103.

TABLE 24

| Description | Unit of quantity | Value |
|---|---|---|
| Nominal diameter | mm | 10 |
| Wire rod name | | Copper wire 1 |
| Wire diameter | mm | 0.050 |
| Maximum coil diameter | mm | 0.055 |
| Number of layers | Layer(s) | 2 |
| Bobbin material | | Resin 1 |
| Bobbin thickness | μm | 50 |
| Bobbin margin | mm | 0.1 |
| Bobbin height | mm | 2.5 |
| Gold thread rod mass | mg | 0.2 |
| Winding width | mm | 1.0 |
| Winding number | Turn(s) | 33 |
| Wire length | m | 0.9 |
| Direct current resistance (DCR) | Ω | 7.1 |
| Coil mass | mg | 19 |

TABLE 24-continued

| Description | Unit of quantity | Value |
|---|---|---|
| Total mass | mg | 22 |
| Max. Voice coil diameter | mm | 8.6 |
| Voice coil inductance | H | 0.0001 |

After this, the preprocessing evaluation means 115 re-executes the step of deciding the shape (Step 109). In result, the preprocessing evaluation means 115 obtains the decision result that the bobbin 76 (or the voice coil 71) does not touch the yoke 74 in the vibration direction of voice coil 71.

In case where affirmative decision results can be obtained regarding all of the decision items 1 to 5, that effect is displayed on the display 119. At this time, the calculated results in the preprocessing result file F-2 (see FIG. 12) as shown in Table 17 is rewritten to those shown in Table 24.

Next, the user inputs to the speaker design support apparatus from the input means 101 the data for the diaphragm thickness and the diaphragm gravity. For example, the user inputs from the input means 101 those data shown in the following Table 25; the diaphragm thickness is 30 μm; and the diaphragm gravity is 1.3 mg/mm$^3$. Besides, the contents of table 25 are displayed on the display 119.

TABLE 25

| Description | Unit of quantity | Value |
|---|---|---|
| Diaphragm thickness | mm | 30 |
| Diaphragm gravity | mg/mm$^3$ | 1.3 |
| Effective vibration area | mm$^2$ | |
| Diaphragm mass | mg | |

The preprocessing means 103 calculates the effective vibration area Sd from an effective vibration diameter (14.5 mm, see Table 1) of the requirements inputted from the input means 101 (Step 111), and also calculates the diaphragm mass based on the calculated effective vibration area Sd and the data of diaphragm thickness and the diaphragm gravity. The calculated effective vibration area Sd and the diaphragm mass are stored in the preprocessing result file F-2 of the storage means 118 (see FIG. 12) together with the data of the diaphragm thickness and the data of diaphragm gravity as shown in the following Table 26. The effective vibration area Sd and the diaphragm mass and the data of diaphragm thickness and gravity shown in Table 26 are displayed on the display 119. Besides, the effective vibration area Sd becomes a coupling factor Sd of the equivalent circuit shown in FIG. 6.

TABLE 26

| Description | Unit of quantity | Value |
|---|---|---|
| Diaphragm thickness | mm | 30 |
| Diaphragm gravity | mg/mm$^3$ | 1.3 |
| Effective vibration area | mm$^2$ | 165.13 |
| Diaphragm mass | mg | 6.44 |

In this way, the preprocessing result file F-2 (see FIG. 12) includes the contents of Tables 24, 22 and 26.

Figure 13:
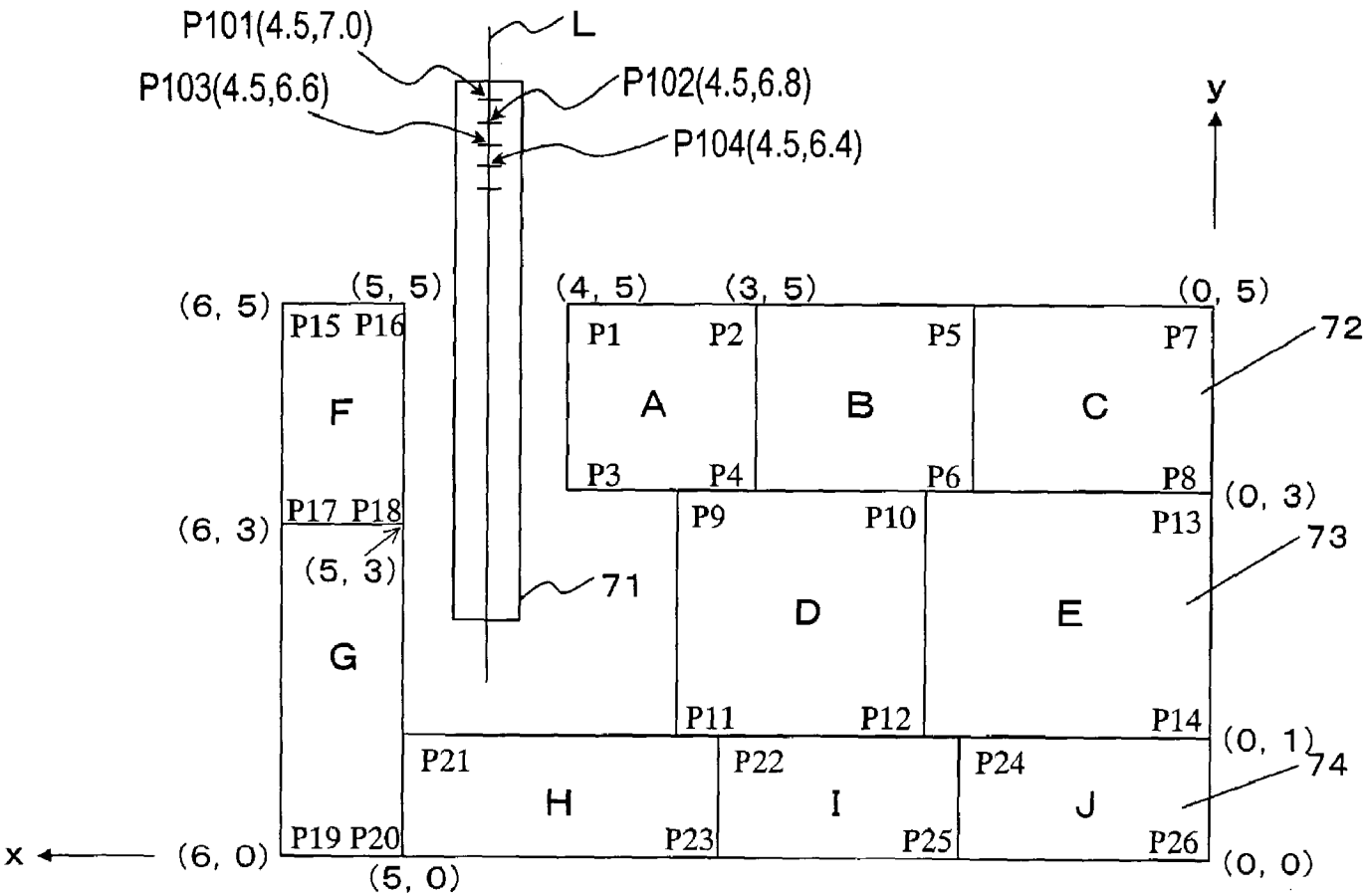
FIG. 13 is a diagram explaining each member composing the magnetic circuit in the second embodiment of the invention.

Next, the preprocessing means 103 creates data for each block of respective members (which are called the nodal point data and the element data hereinafter) composing the magnetic circuit shown in FIG. 13 (Step 112). Here, FIG. 13 shows a mid-sectional view of the magnetic circuit The configuration of the magnetic circuit is explained hereinafter according to FIG. 13. As shown in FIG. 13, the magnetic circuit is consisted from a plurality of portions. For instance, the shape of portion F is a rectangle and has 4corners. The numerals such as P15, P16, P17, and P18 are imparted to the 4corners in advance. Likewise, the portion G is also a rectangle and has 4 corners. The numerals such as P17, P18, P19, and P20 are imparted to the 4 corners in advance. The ratio of a segment P15-P17 connecting P15 and P17 and a segment P17-P19 connecting P17 and P19 is defined in advance. For instance, the ratio of the segment P15-P17 and the segment P17-P19 is defined as 2:3. Those numerals and the predetermined items are stored in the storage means 118 in advance.

Under conditions that each numeral of respective portion corners and the ratio of each segment of adjacent two corners are predetermined for the magnetic circuit shown in FIG. 13, the preprocessing means 103 creates the nodal point data and the element data as shown in the following Tables 27 and stores them into a shape file F-3 of the storage means 118 (see FIG. 12).

TABLE 27

| Elements | | | | | | |
|---|---|---|---|---|---|---|
| EL | A | 2 | P1 | P2 | P3 | P4 |
| EL | B | 2 | P2 | P5 | P4 | P6 |
| EL | C | 2 | P5 | P7 | P6 | P8 |
| EL | D | 2 | P9 | P10 | P11 | P12 |
| EL | E | 2 | P10 | P13 | P12 | P14 |
| EL | F | 2 | P15 | P16 | P17 | P18 |
| EL | G | 2 | P17 | P18 | P19 | P20 |
| EL | H | 2 | P21 | P22 | P20 | P23 |
| EL | I | 2 | P22 | P24 | P23 | P25 |
| EL | J | 2 | P24 | P14 | P25 | P26 |

| Nodal point | | | |
|---|---|---|---|
| NM | P1 | 4 | 5 |
| NM | P2 | 3 | 5 |
| . . . | . . . | . . . | . . . |
| NM | P15 | 6 | 5 |
| NM | P16 | 5 | 5 |
| NM | P17 | 6 | 3 |
| NM | P18 | 5 | 3 |
| NM | P19 | 6 | 0 |
| NM | P20 | 5 | 0 |
| NM | P21 | 2 | 24 |
| . . . | . . . | . . . | . . . |
| NM | P26 | 0 | 0 |

| NS | | | |
|---|---|---|---|
| NS | P101 | 4.5 | 7.0 |
| NS | P102 | 4.5 | 6.8 |
| NS | P103 | 4.5 | 6.6 |
| NS | P104 | 4.5 | 6.4 |
| NS | P105 | 4.5 | 6.2 |
| NS | P106 | 4.5 | 6.0 |
| NS | P107 | 4.5 | 5.8 |
| NS | P108 | 4.5 | 5.6 |
| NS | P109 | 4.5 | 5.4 |
| NS | P110 | 4.5 | 5.2 |
| . . . | . . . | . . . | . . . |

The above Tables 27 are explained here in detail. Regarding the element, "EL" represents a name of the element. The letters "A" to "F" described at the right side of "EL" represents the element number. That is to say, those letters corresponds to respective portions "A" to "F" of the magnetic circuit in FIG. 13. The number described at the right side of the element number is a physical property for a portion material on the same line as the number is described. The four numbers described at the right side of the physical property number are nodal point numbers showing 4 corners for each portion. For instance, taking the region F of the magnetic circuit in FIG. 13 as an example, respective P15, P16, P17, and P18, which are described in the same line as the element number F, corresponds to respective P15, P16, P17, and P18 indicating respective corners of the region F in FIG. 13. Here, the physical property number adopts the number that is imparted in advance to the plate, the yoke and the magnet selected by the user at the step of selecting the necessary items for designing the magnetic circuit (Step 107). The corresponding relation between those physical property numbers and the respective physical properties of the plate, the yoke and the magnet is stored in the storage means 118 in advance.

The "nodal point" is explained here. "NM" in the head position is a nodal point name, and represents a nodal point composing each element. The number at the right side of "NM" is a nodal point number indicating each corner of respective portions "A" to "F" of the magnetic circuit in FIG. 13, and is numbered sequentially. In two columns at the right side of such column, coordinates position of each nodal point are represented by the x-coordinate and the y-coordinate in this order. In case of taking the portions F and G of the magnetic circuit in FIG. 13 as example, the nodal point P15 of the portion F locates at the position that the x-coordinate is 6 and the y-coordinate is 5. And the nodal point P17 of the portion F in FIG. 13 locates at the position that the x-coordinate is 6 and the y-coordinate is 3. The nodal point P19 of the portion G locates at the position that the x-coordinate is 6 and the y-coordinate is 0. Besides, the coordinates are imparted to each nodal point of respective portions in FIG. 13.

"NS" shown in Tables 27 is explained here the "NS" is a nodal point name and the name indicating the calculation position of the magnetic flux density in a space at which the voice coil is placed. Specifically, it represents each position-coordinates name on a central axis (a line L shown in FIGS. 7 and 13) in the direction of the thickness for the voice coil placed between the plate and the yoke. The number described at the right side of "NS" represents the nodal point number. That is to say, the numbers represent respective position numbers of plural points composing the central axis L in the direction of the thickness at the winding portion of the voice coil. For instance, a serial number are imparted to the points from the top of the central axis L (the part contacting the diaphragm) at specific intervals (e.g., ½ of the maximum coil diameter). And the number described at the right side of the number represents the x-coordinate and y-coordinate of each nodal point number position.

After the preprocessing means 103 creates and stores the shape file F-3 in the storage means 118 in the way described above, the preprocessing means 103 creates a condition file F-4 (see FIG. 12) for the calculation of the magnetic flux density distribution for the magnetic circuit (Step 113). The contents of the condition file F-4 are described in Tables 28.

TABLE 28

| Magnet material name | Magnetic flux density (B) | Magnetic Field (H) |
|---|---|---|
| (1) Magnetic flux density calculation command | | |
| (2) Magnet material data | | |
| Magnet 1 | −10000 | 0 |
| | 0 | 1 |
| (3) Plate material data | | |
| Metal 1 | 240.0 | 0.6 |
| | 320.0 | 0.8 |
| | 330.0 | 0.9 |

TABLE 28-continued

| Magnet material name | Magnetic flux density (B) | Magnetic Field (H) |
|---|---|---|
| | . | . |
| | . | . |
| | . | . |
| (4) Yoke material data | | |
| Metal 1 | 240.0 | 0.6 |
| | 320.0 | 0.8 |
| | 330.0 | 0.9 |
| | . | . |
| | . | . |
| | . | . |

The detailed contents of the condition file F-4 shown in Tables 28 are explained here. The condition file F-4 is consisted from a command to make the magnetic circuit design means 104 calculate the magnetic flux density distribution for the magnetic circuit assuming that the magnetic circuit is in a symmetrical shape with the y-axis as the central axis, and the material data of the plate, the yoke and the magnet composing the magnetic circuit selected at the step of inputting or selecting the necessary items for designing the magnetic circuit (Step 107).

Next, in the speaker design support apparatus of the second embodiment, the magnetic circuit design means 104 calculates as follows in order to obtain the magnetic flux density distribution for the magnetic circuit composing the speaker.

After the shape file F-3 and the condition file F-4 are created as described above, the magnetic circuit design means 104 calculates the magnetic flux density distribution for the magnetic circuit based on the shape file F-3 and the condition file F-4 assuming that the magnetic circuit is a rotational symmetric body with the y-axis shown in FIG. 13 as the central axis (Step 114). The calculated results shown in the following Table 29 is obtained for the magnetic flux at each point on the central axis (the line L in FIGS. 7 and 13) in the direction of the thickness at the winding portion of the voice coil. The calculated results of the magnetic flux density distribution are stored in a magnetic circuit calculation result file F-5 (see FIG. 12) of the storage means 118, and then the results are displayed on the display 119. The result of the magnetic flux density distribution is made a graph shown in FIG. 4 and displayed on the display 119. Besides, FIG. 4 is explained in the first embodiment, and therefore it is not described in detail in this the second embodiment.

TABLE 29

| Position (mm) | Bg(T) |
|---|---|
| −0.825 | 0.038 |
| −0.788 | 0.051 |
| −0.751 | 0.065 |
| . | . |
| . | . |
| . | . |
| −0.074 | 0.319 |
| −0.037 | 0.329 |
| 0.000 | 0.330 |
| 0.037 | 0.338 |
| 0.074 | 0.328 |
| . | . |
| . | . |
| . | . |
| 0.751 | 0.151 |
| 0.788 | 0.145 |
| 0.825 | 0.135 |

The magnetic circuit design means 104 calculates the magnetic flux density at each point on the central axis in the direction of the thickness at the winding portion of the voice coil as described above, and also calculates the value of the magnetic flux density for each predetermined portion of the magnetic circuit. According to such calculation, it is possible to obtain the value of the magnetic flux density for each predetermined portion of the magnetic circuit. For instance, the value of the magnetic flux density can be obtained for the portion A of the plate 72 composing the magnetic circuit as shown in FIG. 8. Besides, the calculated result of the value of the magnetic flux density for each predetermined portion of the magnetic circuit is also stored in the magnetic circuit calculation result file F-5 of the storage means 118 (see FIG. 12).

The magnetic circuit design means 104 obtains the permeance factor from the calculated magnetic flux density distribution for the magnet (Step 114). The permeance factor is stored in the magnetic circuit calculation result file F-5 of the storage means 118 (see FIG. 12) together with the magnetic flux density distribution.

Next, in the speaker design support apparatus of the second embodiment, the intermediate processing means 105 calculates as follows to create data for calculating the equivalent circuit. This calculation may be executed prior to a calculation of a various frequency characteristic of the speaker.

The intermediate processing means 105 performs a computation by substituting the calculated result of the magnetic flux density distribution for the magnetic circuit stored in the magnetic circuit calculation result file F-5 (see FIG. 12) into a force calculating expression stored in the magnetic circuit calculation result file F-5 of the storage means 118 to obtain the force acting on the voice coil (Step 115). In result, the factor B1 of the force acting on the central point (point C in FIG. 7) in the direction of the thickness at the winding portion of the voice coil can be obtained corresponding to the displacement value of the voice coil moves from the statistic position due to the vibration, and the relation between the displacement value and the force factor B1 is shown in the following Table 30. The obtained relation (contents shown in Table 30) is stored in a force factor calculation result file F-6 (see FIG. 12) of the storage means 118, and then displayed on the display 119. In addition, the relation between the displacement value of the voice coil from the statistic position due to the vibration and the value of factor B1 of the force acting on the central point (Point C in FIG. 7) in the direction of the thickness at the winding portion of the voice coil is made a graph as shown in FIG. 5, and then displayed on the display 119. Besides, FIG. 5 has been explained in the first embodiment, therefore, it is not explained in detail in the second embodiment.

TABLE 30

| Displacement value (mm) | B1(Tm) |
|---|---|
| −0.140 | 0.2106 |
| −0.112 | 0.2148 |
| −0.084 | 0.2182 |
| −0.056 | 0.2207 |
| −0.028 | 0.2221 |
| 0.000 | 0.2228 |
| 0.028 | 0.2222 |
| 0.056 | 0.2208 |
| 0.084 | 0.2184 |
| 0.112 | 0.2152 |
| 0.140 | 0.2090 |

As explained in the first embodiment, if the signals inputted to the voice coil are periodical alternating current signals, the force factor B1 of the force acting on the voice coil changes periodically as time passes. Accordingly, the intermediate processing means 105 obtains as an effective force factor a root-mean-square value of the force factor B1 of the force acting on the voice coil changing periodically (Step 116). And the intermediate processing means 105 stores the effective force factor in the intermediate processing result file F-6 (see FIG. 12) of the storage means 118. Besides, the effective force factor becomes a coupling factor B1 of the equivalent circuit shown in FIG. 6.

Next, based on the shape of the voice coil, the diaphragm mass stored in the preprocessing result file F-2 (see FIG. 12) and the information of adhesive bonding the voice coil and the diaphragm, the intermediate processing means 105 creates shape data of the voice coil, the shape data of the diaphragm, and data of the adhesives in the form applicable to an effective vibration system mass calculating expression stored in the storage means 118.

After that, the intermediate processing means 105 peforms a computation by substituting thus created shape data of voice coil and diaphragm and data of adhesives into the effective vibration system mass calculating expression to obtain as effective vibration system mass Mmd the effective mass on the vibration system of the speaker like the voice coil (Step 117). The intermediate processing means 105 stores the effective vibration system mass Mmd in an intermediate processing result file F-7 of the storage means 118 (see FIG. 12). The effective vibration system mass Mmd is also displayed on the display 119. Here, the effective vibration system mass Mmd does not include the acoustic loading mass like the air.

Next, the intermediate processing evaluation means 116 compares the magnetic flux density for each portion of the magnetic circuit obtained by the magnetic circuit design means 104 and the data pre-stored in the storage means 118 as shown in FIG. 9 to be a criterion to decide whether the magnetic flux density is saturated or not, and then decides whether the magnetic flux density for each portion of the magnetic circuit is saturated (Step 14). For instance, regarding the portion A of the plate 72 composing the magnetic circuit shown in FIG. 8, it is decided whether the magnetic flux density is saturated or not. And based on the permeance factor stored in the magnetic circuit calculation result file F-5 (see FIG. 12) and the standard permeance factor stored in the storage means 118, the intermediate processing evaluation means 116 decides whether there is a possibility of occurrence of demagnetization due to the temperature change in the magnet composing the magnetic circuit to be designed (Step 118). Those decision results are displayed on the display 119.

At this time, if it is decided that the magnetic flux density is saturated at any portion of the magnetic circuit, or that there is a possibility of occurrence of demagnetization due to the temperature change in the magnet composing the magnetic circuit to be designed, the warning is displayed on the display 119. Thereupon, the processing turns back to the step (Step 119) that the user inputs to the speaker design support apparatus the request to present the shape of the voice coil together with the necessary items to design the voice coil using the input means and then the steps up to the step (Step 117) of calculating the effective vibration system mass are re-executed.

If it is decided that the magnetic flux density is not saturated at any portion of the magnetic circuit, or that there is no possibility of occurrence of demagnetization due to the temperature change in the magnet composing the magnetic circuit to be designed, the intermediate processing means 105 performs a computation by substituting the minimum resonance frequency Fs of the requirements inputted by the input means 101 and the value Mms based on thus obtained effective vibration system mass Mmd into a compliance calculating expression stored in the storage means 118. And the intermediate processing means 105 obtains the compliance Cms of the diaphragm edge (retaining system spring constant) by this calculation (Step 119). The compliance Cms is stored in the intermediate processing result file F-7 of the storage means 118, and then displayed on the display 119. Here, the compliance calculating expression is represented by the following Expression 6. The value "Mms" in Expression 6means the effective vibration system mass Mmd added with the acoustic loading mass. And the compliance Cms of diaphragm edge is applied to the calculation using the equivalent circuit shown in FIG. 6.

$$\text{Compliance of diaphragm edge } Cms = 1/(Mms \times (2 \times \pi \times Fs)^2) \qquad \text{Expression 6:}$$

Mms: Effective vibration system mass Mmd added with acoustic loading mass

Fs: Minimum resonance frequency

After that, the user inputs to the speaker design support apparatus the acoustic data such as the frame of the speaker by means of the inputting means 101 (step 120). The acoustic data are shape information of a frame size, a shape of through-hole provided to the frame (diameter or depth of the through-hole), a shape of the acoustic resistance material covering the through-hole, a shape of a protector provided at the front of the speaker (diameter and depth of hole provided to the protector), and whether the diaphragm is in a corrugated sheet form or a flat sheet form.

The intermediate processing means 105 calculates the acoustic impedance of the front and the back of the diaphragm using an air density, a sound velocity value, and a correction factor shown in the following Table 31 of a correction database DB3 stored in the storage means 118, on the basis of the acoustic system data. Besides, the correction factor used by the calculation is selected from "first correction factor, second correction factor, . . . " shown in Table 31, for example.

TABLE 31

| Input item | Value | Item description |
|---|---|---|
| ρ | 1.1871 | Air density [kg/m^3] |
| c | 343.3 | Sound velocity [m/s] |
| First correction factor | 0.9 | Correction factor |
| Second correction factor | 0.7 | Correction factor |
| . | . | . |
| . | . | . |
| . | . | . |

In case where the equivalent circuit shown in FIG. 6 is taken as an example, the intermediate circuit 105 calculates the acoustic impedance $Z_{a1}$ of the diaphragm front and the acoustic impedance $Z_{a2}$ of the diaphragm back in the equivalent circuit. If the impedance "$Z_{a1}$" illustrated in the equivalent circuit in FIG. 6 is consisted from a resistance, a compliance, and an acoustic mass (acoustic inertance), the intermediate processing means 105 obtains as an acoustic impedance Za1 of the diaphragm front the impedance value for all of the resistance, the compliance and the acoustic mass.

Thus obtained calculation results of the acoustic impedance of the diaphragm front and back are stored in the intermediated processing result file F-7 of the storage means 118 (see FIG. 12), and then displayed on the display 119.

Next, the user inputs to the speaker design support system in the second embodiment a value known from his or her experience or a value calculated back from the mechanical system Qms value of the speaker desired by the user, by means of the input means 101. The inputted value is stored in the intermediate processing result file F-7 of the storage means 118 (see FIG. 12).

After that, the intermediate processing means 105 copies the values of the direct current resistance (DCR) Re, the inductance Le, and the effective vibration area Sd, which are stored into the preprocessing result file F-2, to the intermediate processing result file F-7 of the storage means 118.

As described above, the intermediate processing result file F-7 stores respective values of the direct current resistance (DCR) Re, the inductance Le, the coupling factor B1, the inductance Mmd, the condenser Cms, the resistance Rms, the coupling factor Sd, the acoustic impedance $Z_{a1}$ of the diaphragm front and the acoustic impedance $Z_{a2}$ of the diaphragm back, as shown in the following Table 32.

TABLE 32

| Description | Symbol | Unit of quality | Value |
|---|---|---|---|
| Direct current resistance of voice coil | Re | Ω | 27.0 |
| Inductance of voice coil | Le | H | 0.015 |
| Force factor (coupling factor) | Bl | Tm | 0.70 |
| Effective vibration system mass | Mmd | g | 0.02 |
| Retaining system mechanical compliance | Cms | m/N | 0.01 |
| Retaining system mechanical resistance | Rms | Kg/s | 0.01 |
| Effective vibration area (coupling factor) | Sd | m^2 | 0.24 |
| Acoustic impedance of diaphragm front | Za1 | Pa · s/m^3 | 1.05E+07 |
| Acoustic impedance of diaphragm back | Za2 | Pa · s/m^3 | 1.00E+06 |

In the next step, in order to calculate various frequency characteristics of the speaker, the speaker design support apparatus of the second embodiment is arranged so that the equivalent circuit design means 106 calculates as follows to obtain a specific value regarding the equivalent circuit using respective data stored in the intermediate processing result file F-7.

The equivalent circuit design means 106 calculates a current value I on the corresponding part of the equivalent circuit to the electric system and a velocity value V of the corresponding part of the equivalent circuit to the mechanical system for each frequency by changing in frequency the alternating current power of the equivalent circuit, based on the values stored in the intermediate processing result file F-7 as the values for respective elements of the equivalent circuit shown in FIG. 6 (Step 121). Here, in the following explanation, the current value V on the mechanical system circuit becomes the diaphragm velocity V. And the current value I and the velocity V can be obtained by calculating the equivalent circuit in FIG. 6 in consideration of the mutual relation between the electromotive force and the counter electromotive force.

Next, the speaker design support apparatus of the second embodiment is arranged so that the equivalent circuit design means 106 calculates as follows to obtain various frequency characteristics of the speaker.

Figure 14:
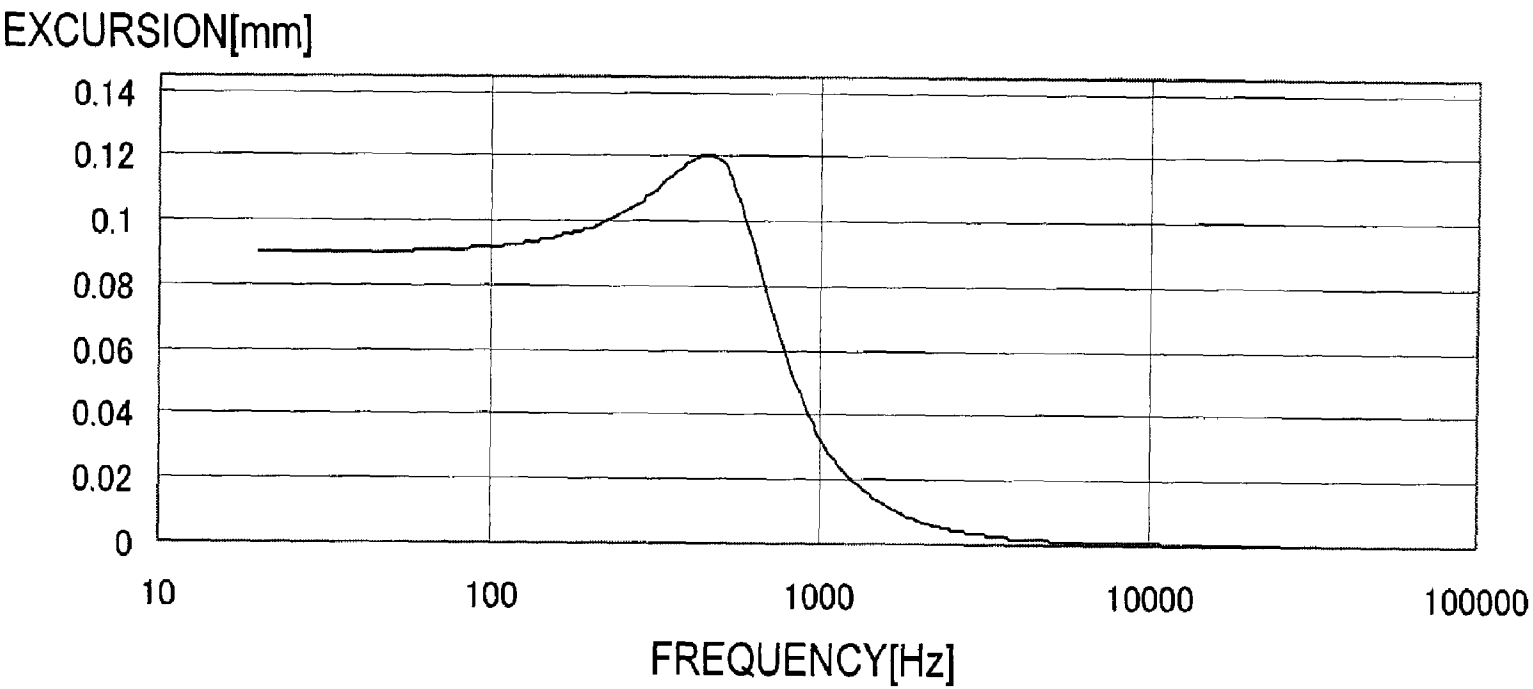
FIG. 14 is a diagram showing the excursion frequency characteristic of speaker in the second embodiment of the invention.

The frequency characteristic calculation means 107 substitutes the velocity V obtained by the above calculation into the following Expression 7 to calculate every frequency within the predetermined frequency band (e.g., audio frequency band) the excursion of the diaphragm composing the speaker (Step 122). In result, it is possible to obtain the diaphragm excursion value every frequency (the excursion frequency characteristic data) as shown in the following Table 33. The excursion frequency characteristic data is stored in an excursion file F-9 of the storage means 118 (see FIG. 12). In addition, the excursion frequency characteristic data is made a graph as shown in FIG. 14, and also displayed on the display 119.

Excursion frequency characteristic $X=V/(j\omega)$ Expression 7:

TABLE 33

| Frequency (Hz) | Excursion (mm) |
|---|---|
| 20.0 | 0.089 |
| 20.7 | 0.089 |
| 21.4 | 0.089 |
| 22.2 | 0.089 |
| 23.0 | 0.089 |
| . | . |
| . | . |
| . | . |
| 17419.0 | 0.000 |
| 18031.0 | 0.000 |
| 18665.0 | 0.000 |
| 19321.0 | 0.000 |
| 20000.0 | 0.000 |

Figure 15:
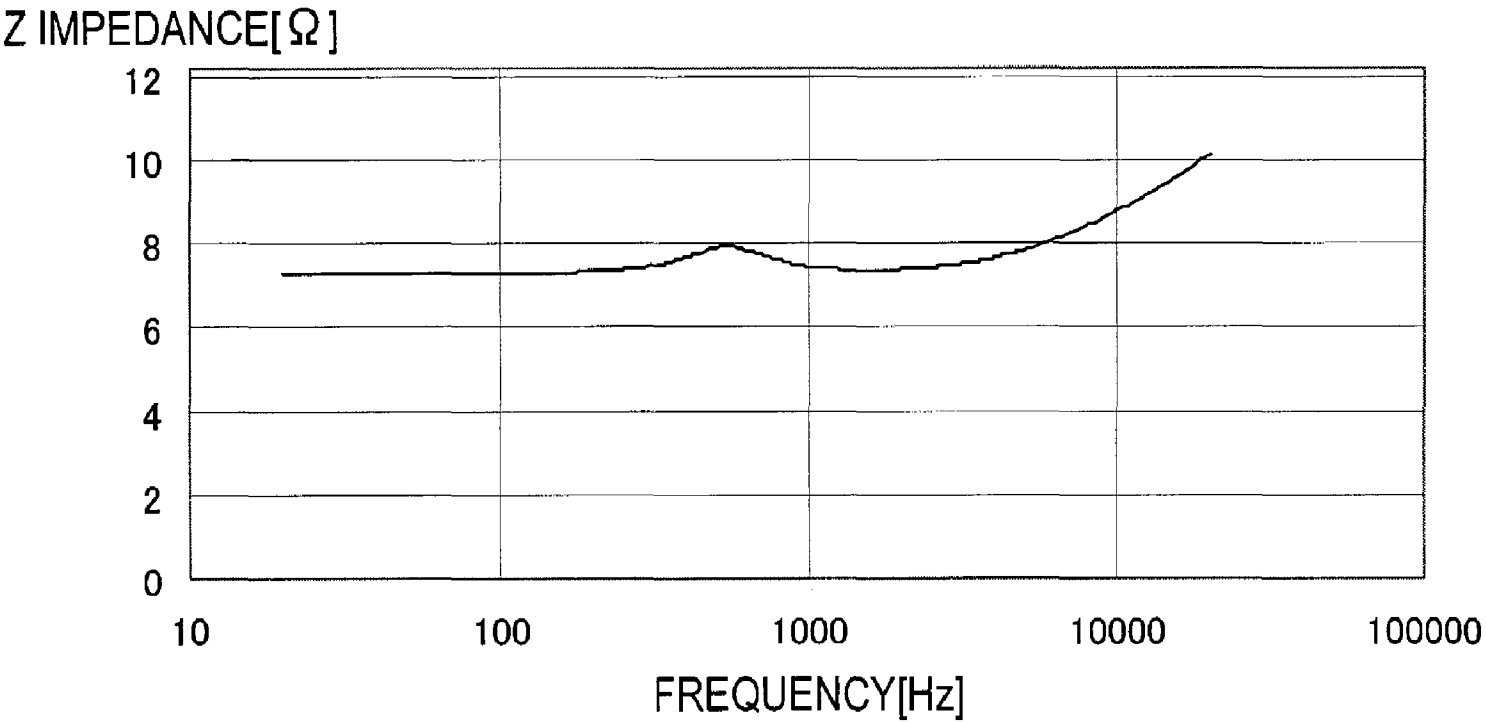
FIG. 15 is a diagram showing the impedance frequency characteristic of speaker in the second embodiment of the invention.

The frequency characteristic calculation means 107 substitutes thus obtained current value I into the following expression 8 to calculate the impedance of the speaker every frequency of the predetermined frequency band (e.g., audio frequency band) (Step 123). That is to say, the impedance frequency characteristic of the speaker is calculated. As the result of the calculation, the impedance value for each frequency (impedance frequency characteristic data) can be obtained as shown in the following Table 34, and the impedance frequency characteristic data is stored in a Z-impedance file F-10 of the storage means 118 (see FIG. 12). Additionally, the impedance frequency characteristic data is made to a graph in a form shown in FIG. 15, and also displayed on the display 119.

Impedance frequency characteristic $Z=E/I$ Expression 8:

TABLE 34

| Frequency (Hz) | Z-impedance (Ω) |
|---|---|
| 20.0 | 7.682 |
| 20.7 | 7.682 |
| 21.4 | 7.682 |
| 22.2 | 7.683 |
| 23.0 | 7.383 |
| . | . |
| . | . |
| . | . |
| 17419.0 | 10.163 |
| 18031.0 | 10.244 |
| 18665.0 | 10.322 |
| 19321.0 | 1.0395 |
| 20000.0 | 10.466 |

Moreover, the frequency characteristic calculation means 107 obtains a voltage value across a predetermined element (e.g., compliance) of $Z_{a1}$ of the equivalent circuit in FIG. 6 for each frequency within the predetermined frequency band (e.g., audio frequency band). Thereby, the sound pressure frequency characteristic, which represents the voltage value as the sound pressure of the diaphragm front for each frequency, is obtained (Step 124).

Likewise, the frequency characteristic calculation means 107 obtains a voltage value across a predetermined element (e.g., compliance) of $Z_{a2}$ of the equivalent circuit in FIG. 6 for each frequency within the predetermined frequency band (e.g., audio frequency band). Thereby, the sound pressure frequency characteristic, which represents the voltage value as the sound pressure of the diaphragm back for each frequency, is obtained (Step 124).

Figure 16:
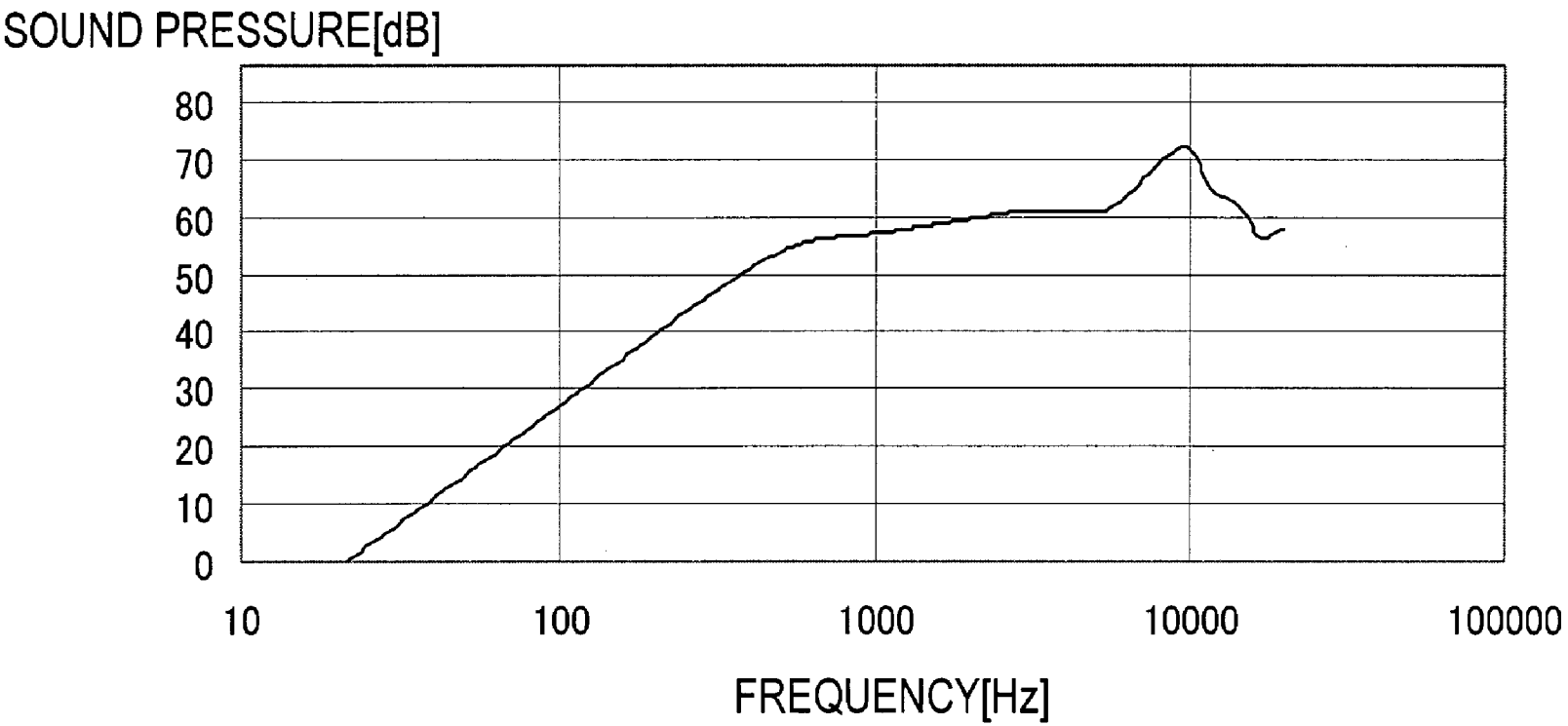
FIG. 16 is a diagram showing the sound pressure frequency characteristic of speaker in the second embodiment of the invention.

The calculated results of the sound pressure characteristics of diaphragm front and back are stored in the sound pressure file F-11 of the storage means 118 (see FIG. 12). Here, the calculated results of the sound pressure characteristics can be obtained in the form of listing values of the frequency and sound pressure for each frequency, as shown in the following Table 35. And such sound pressure frequency characteristic is made a graph in the form shown in FIG. 16, and displayed on the display 119. Here, the predetermined element is decided according to the place that the speaker designed by the speaker design support apparatus in this embodiment is placed on.

TABLE 35

| Frequency (Hz) | Sound Pressure (dB) |
|---|---|
| 20.0 | 0.010 |
| 20.7 | 0.119 |
| 21.4 | 0.236 |
| 22.2 | 0.582 |
| 23.0 | 1.180 |
| . | . |
| . | . |
| . | . |
| 17419.0 | 56.072 |
| 18031.0 | 56.684 |
| 18665.0 | 57.267 |
| 19321.0 | 57.569 |
| 20000.0 | 57.555 |

Next, the speaker design support apparatus in the second embodiment is arranged so that the speaker characteristic calculation means 108 calculates respective characteristics of the speaker by using the calculated results obtained by the frequency characteristic calculation means 107.

The speaker characteristic calculation means 108 extracts the maximum value from the excursion values of the diaphragm for each frequency stored in the excursion file F-9 (see FIG. 12) as a maximum excursion (Step 125). The maximum excursion value is stored in the speaker characteristic file F-12 of the storage means (see FIG. 12). Additionally, the speaker characteristic calculation means 108 calculates the excursion margin by adding a specific value to the maximum excursion (Step 126). The calculated result of the excursion margin is also stored in the speaker characteristic file F-12 of the storage means 118.

The speaker characteristic calculation means 108 extracts values of the sound pressures for a plurality of predetermined frequencies from values of the sound pressures of the diaphragm front for each frequency stored in the sound pressure file F-11 (see FIG. 12), and calculates an average of those extracted sound pressures as SPL (sound pressure) (Step 127). Thus calculated SPL is stored in the speaker characteristic file F-12 of the storage means 118.

By using the values of the impedance corresponding to the minimum resonance frequency Fs (see Table 11) inputted by the user at the step of inputting the requirements out of those stored in the Z-impedance file F-10 (see FIG. 12), the speaker characteristic calculation means 108 the Q-value of the speaker at the minimum resonance frequency Fs (Step 128).

Thus obtained Q-value is stored in the speaker characteristic file F-12 of the storage means 118. After the Q-value is stored in the storage means 118, the speaker characteristic calculation means 108 ends the speaker characteristic calculation.

The final evaluation means 17 decides whether the SPL (sound pressure) obtained by the speaker characteristic calculation means 108 satisfies the target SPL (target sound pressure) of the requirements (Step 129). The final evaluation means 117 also decides whether the speaker thickness satisfies the target thickness of the requirements based on the maximum excursion and the excursion margin obtained by the speaker characteristic calculation means 108 (Step 129). Those decision results are displayed on the display 119.

At this time, if the respective calculated results do not satisfy the requirements, the warning is displayed on the display 119 (Step 130). In this case, the procedure goes back to the step of inputting the command to present the shape of the voice coil together with the necessary items to design the voice coil from the input means 101 to the speaker design support apparatus (Step 104), and then the preprocessing means 103 executes the preprocessing again. Otherwise, it goes back to the step of inputting the acoustic shape (Step 120) and then the intermediate processing means 105 executes the specific processing and the steps following to the step are re-executed. For instance, if the calculated SPL (sound pressure level) obtained by the above calculation is lower than the target SPL (target sound pressure level), the procedure goes back to the step (S104) for reducing the mass of the voice coil because the sound pressure becomes high by reducing the effective mass of the vibration system. In addition, for instance, if the calculated speaker thickness based on the maximum excursion and the excursion margin of the diaphragm is larger than the target thickness, it goes back to the step of inputting data to increase the diameter of the through-hole (Step 120) because the excursion value becomes small by increasing the diameter of the through-hole provided to the frame and the speaker thickness can be reduced.

And if it is decided that the respective calculated results satisfy the requirements, the message indicating such contents is displayed on the display 119. Consequently, the designing of speaker is completed. And the output data creating means 109 extracts data for a specific item to be described in the design specification from the data filed into the speaker characteristic file F-12 from the approximate excursion file F-1, and creates the design specification data to be outputted as shown in the following Table 36, and then stores the created data in the output file F-13 of the storage means 118. Additionally, the data of the output file F-13 is printed out as the design specification (Step 131).

TABLE 36

| Description | Symbol | Unit of quantity | Value |
|---|---|---|---|
| First frequency for SPL average | | Hz | 1000 |
| Second frequency for SPL average | | Hz | 1500 |
| SPL | | dB | 108.0 |
| Max. Excursion | | mm | 0.2 |
| Excursion margin | | mm | 0.32 |
| Effective vibration diameter | dD | mm | 0.36 |
| Effective vibration area | Sd | m^2 | 0.24 |
| Direct current resistance of voice coil | Re | Ω | 27.00 |
| Min. resonance frequency | | Hz | 385.00 |
| Impedance of min. resonance frequency | | Ω | 35.00 |
| Force factor | Bl | Tm | 0.07 |
| Effective vibration system mass | Mmd | g | 0.02 |

TABLE 36-continued

| Description | Symbol | Unit of quantity | Value |
|---|---|---|---|
| Mechanical compliance of retaining system | Cms | m/N | 0.01 |
| Mechanical resistance of retaining system | Rms | Kg/s | 0.01 |
| Total Q | | | 2.08 |
| Diameter | | mm | 10.00 |
| Thickness | | mm | 2.68 |

As described above, by using the speaker design support apparatus in the second embodiment, it is possible to finish a design of a speaker with less frequency of designing a speaker, and it makes possible to design the speaker meeting the specific requirements in a short time.

Besides, in the second embodiment described above, it is assumed that the equivalent circuit file F-8 of the storage means 118 (see FIG. 18) stores the equivalent circuit shown in FIG. 6, and the equivalent circuit design means 106 performs a specific calculation for the equivalent circuit shown in FIG. 6. However, it may be arranged that the user select either one of the plurality of equivalent circuits including the equivalent circuit shown in FIG. 6 stored in the equivalent circuit file F-8, meanwhile the equivalent circuit 106 performs the specific calculation regarding the equivalent circuit selected by the user as described in the second embodiment.

In addition, in the second embodiment, it is assumed that the intermediate processing evaluation means 116 of the speaker design support apparatus decide whether the magnetic flux density obtained by the magnetic circuit design means 104 is saturated at each portion of the magnetic circuit, and that the intermediate processing evaluation means 116 decide based on the permeance factor obtained by the magnetic circuit design means 104 whether there is a possibility of the occurrence of demagnetization in the magnet composing the magnetic circuit to be designed due to the change of temperature. However, it may be arranged that the user may decide either one or both of the above decision items; whether the magnetic flux density is saturated at each portion of the magnetic circuit, and whether there is a possibility of the occurrence of demagnetization due to the change of temperature.

Moreover, in the second embodiment, it is assumed, in the step of selecting the necessary items to design the voice coil (Step 104) and the step of selecting the necessary items to design the magnetic circuit (Step 107), that the user select either one of respective selectable objects of Table 13, Table 14, Table 15, Table 19, and Table 20 that are stored in the storage means 118. However, the user use can change or add the respective selectable objects in Table 13, Table 14, Table 15, Table 19 and Table 20.

And in the second embodiment, it is arranged so as to print out the contents of the output file F-13 as the design specification. However, it may be also arranged so as to print out all or some of data stored in the storage means 118, such data as the approximate excursion file Fl to the speaker characteristic file F-12, according to the user's instruction or automatically.

At least one of the magnetic circuit design means 104 and the equivalent circuit design means 106 in the second embodiment may be a means for performing the corresponding calculations using the multi-purpose software.

It is assumed in the first and second embodiments that the speaker design support apparatus be used to design the speaker comprising at least the voice coil, the magnetic circuit, and the diaphragm. However, the apparatus can be used to design the receiver applied to the receiving unit of the mobile phone, for example. Specifically, the apparatus can be used to design the apparatus comprising at least the voice coil, the magnetic circuit, and the diaphragm for outputting sound.

Additionally, respective components of the speaker design support apparatus in the first and second embodiments may be configured by the hardware or the software.

In addition, in order to carry out the speaker design support apparatus in the first and second embodiments, the program making a computer operate as each component of the speaker design support apparatus may be used. The program may be distributed by using a computer-readable recording medium such as CD-ROM, and the like, or put on a market through electric communication circuit like the Internet.

According to the above description, it is clear that the invention can provide the speaker design support apparatus capable of designing the speaker in a short time.

By using the speaker design support apparatus of this invention, it is possible to finish manufacturing the speaker by way of trial with less frequency than before and to make even unskilled person design the speaker same as the skilled person.

The invention claimed is:

1. A speaker design support apparatus that supports the designing for a speaker provided with at least a voice coil, a magnetic circuit, and a diaphragm, the speaker design support apparatus comprising:

input means for inputting design data to design the voice coil, the magnetic circuit, and the diaphragm;

coil calculation means for calculating a shape of the voice coil based on the design data of the voice coil;

magnetic circuit calculation means for calculating a shape of the magnetic circuit based on the design data of the magnetic circuit;

diaphragm calculation means for calculating a maximum excursion and excursion margin of a diaphragm based on the design data of the diaphragm;

shape deciding means for deciding whether or not a fixed portion interferes in a vibration of a moving portion, by using the shape of the voice coil, the shape of the magnetic circuit, and the maximum excursion and excursion margin of the diaphragm; and display means for displaying characteristics of the speaker based on the inputted design data, and a calculated result.

2. The speaker design support apparatus according to claim 1, wherein the magnetic circuit is formed by placing a magnetic plate on a magnet being at a center of a patelliform yoke, the diaphragm is placed in front of the yoke, the fixed portion is the magnetic plate, and the moving portion is the diaphragm.

3. The speaker design support apparatus according to claim 1, wherein the magnetic circuit is formed by placing a magnetic plate on a magnet being at a center of a patelliform yoke, the diaphragm is placed in front of the yoke, the fixed portion is the yoke, and the moving portion is an edge of the diagraph.

4. The speaker design support apparatus according to claim 1, wherein the magnetic circuit is formed by placing a magnetic plate on a magnet being at a center of a patelliform yoke, the diaphragm is placed in front of the yoke, the fixed portion is the yoke, and the moving portion is a lower edge if a bobbin perpendicular to the diaphragm and inserted in a gap between the yoke and the magnetic plate.

5. The speaker design support apparatus according to claim 1, wherein the magnetic circuit is formed by placing a magnetic plate on a magnet being at a center of a patelliform yoke, the diaphragm is placed in front of the yoke, the fixed portion is the yoke, and the moving portion is the voice coil winding around a bobbin.

6. The speaker design support apparatus according to claim 1, wherein the magnetic circuit is formed by placing a magnetic plate on a magnet being at a center of a patelliform yoke, the diaphragm is placed in front of the yoke, the shape deciding means further decides whether or not the speaker requires a bobbin hanging down from the diaphragm in a gap between the yoke and the plate.

7. A speaker design support apparatus supporting the designing of a speaker provided with a voice coil, a magnetic circuit, and a diaphragm, the speaker design support apparatus comprising:

input means for inputting design data to design the voice coil, the magnetic circuit, and the diaphragm;

calculation means for calculating the speaker characteristics based on the inputted design data;

display means for displaying the calculated result;

calculating expression storage means for storing calculating expressions for calculating the speaker characteristics based on in the inputted design data; and magnetic flux density calculation data creating means for creating magnetic flux density calculation data based on the voice coil shape and the magnetic circuit shape obtained using the coil calculating expression and the circuit calculating expression, and wherein the calculating means calculates the speaker characteristics by means of the calculating expression, calculates a shape of a voice coil based on the design data of the voice coil by means of at least a coil calculating expression included in the calculating expression, and calculates a shape of a magnetic circuit based on the design data of the magnetic circuit by means of at least a circuit calculating expression included in the calculating expression, and wherein the calculation means is provided with magnetic flux calculation means for calculating a magnetic flux density distribution for the magnetic circuit based on the magnetic flux density calculation data by means of a magnetic flux density calculating expression included in the calculating expressions.

8. A speaker design support apparatus in accordance with claim 7, further comprising;

force calculation data creating means for creating force calculation data based on the voice coil shape, the magnetic circuit shape, and the magnetic flux density distribution, and wherein the calculation means is provided with force calculation means for calculating force acting on the voice coil based on the force calculation data by means of a force calculating expression included in the calculating expressions.

9. A speaker design support apparatus in accordance with claim 8, further comprising;

effective mass calculation data creating means for creating effective mass calculation data based on the voice coil shape and the diaphragm shape, and wherein the calculation means is provided with mass calculation means for calculating an effective vibration system mass including the voice coil based on the effective mass calculation data by means of an effective vibration system mass calculating expression included in the calculating expressions.

10. A speaker design support apparatus in accordance with claim 9, wherein the calculation means is provided with sound pressure calculation means for calculating a sound pressure frequency characteristic of the speaker based on the voice coil shape, the magnetic circuit shape, the force acting on the voice coil and the effective vibration system mass by means of a sound pressure calculating expression included in the calculating expressions.

11. A speaker design support apparatus in accordance with claim 9, wherein the calculation means is provided with excursion calculation means for calculating an excursion frequency characteristic of the diaphragm based on the voice coil shape, the magnetic circuit shape, the force acting on the voice coil and the effective vibration system mass by means of a diaphragm excursion calculating expression included in the calculating expressions.

12. A speaker design support apparatus in accordance with claim 11, wherein the excursion calculation means also calculates an excursion margin of the diaphragm based on the excursion frequency characteristic of the diaphragm.

13. A speaker design support apparatus in accordance with claim 9, wherein the calculation means is provided with impedance calculation means for calculating the impedance frequency characteristic of the speaker based on the voice coil shape, the magnetic circuit shape, the force acting on the voice coil, and the effective vibration system mass by means of an impedance calculating expression included in the calculating expressions.

14. A speaker design support apparatus in accordance with claim 9, wherein the calculation means calculates the sound pressure frequency characteristic of the speaker, the excursion frequency characteristic of the diaphragm, and the impedance frequency characteristic of the speaker based on the voice coil shape, the magnetic circuit shape, the force acting on the voice coil, and the effective vibration system mass by means of the sound pressure calculating expression, the diaphragm excursion calculating expression, and the impedance calculating expression.

15. A speaker design support apparatus in accordance with claim 14, wherein the sound pressure calculating expression, the diaphragm excursion calculating expression, and the impedance calculating expression represents an equivalent circuit provided with the relation equivalent to the mutual relation among the voice coil shape, the magnetic circuit shape, the diaphragm shape, and the acoustic system shape of the speaker.

16. A speaker design support apparatus in accordance with claim 15, wherein the calculation means calculates by means of an equivalent circuit selected from a plurality of prepared equivalent circuits.

17. A speaker design support apparatus supporting the designing of a speaker provided with a voice coil, a magnetic circuit, and a diaphragm, comprising;

preprocessing means for calculating shapes of the voice coil and the magnetic circuit;

magnetic circuit design means for obtaining a magnetic flux density distribution for the magnetic circuit based on the shapes of the voice coil and the magnetic circuit;

intermediate processing means for obtaining a factor of force acting on the voice coil and an effective vibration mass based on the voice coil shape, the magnetic circuit shape, and the magnetic flux density distribution for the magnetic circuit; and equivalent circuit design means for obtaining an equivalent circuit of the speaker based on the voice coil shape, the magnetic circuit shape, the factor of force action on the voice coil, and the effective vibration system mass.

18. A speaker design support apparatus in accordance with claim 17, comprising;

approximate excursion calculation means for calculating approximate values of a maximum excursion and an excursion margin of the diaphragm based on the design data of the diaphragm.

19. A speaker design support apparatus in accordance with claim 17, wherein the preprocessing means calculates the voice coil shape based on the design data of the voice coil.

20. A speaker design support apparatus in accordance with claim 17, wherein the preprocessing means calculates the magnetic circuit shape based on the design data of the magnetic circuit.

21. A speaker design support apparatus in accordance with claim 17, wherein the magnetic circuit design means obtains the magnetic flux density distribution for the magnetic circuit based on the shapes of the voice coil and the magnetic circuit obtained by the preprocessing means by means of a specific magnetic flux density calculating expression.

22. A speaker design support apparatus in accordance with claim 21, comprising file storage means for storing;

a shape file including respective position coordinates of component portions composing the voice coil and the magnetic circuit, said coordinates as the shapes of the voice coil and the magnetic circuit obtained by the preprocessing means; and a condition file including a command to calculate the magnetic flux density distribution for the magnetic circuit based on material data of component portions composing the magnetic circuit and the information that the magnetic circuit is a rotational body symmetrical with respect to the central axis by means of the respective position coordinates of component portions included in the shape file, and wherein the magnetic circuit design means obtains the magnetic flux density distribution for the magnetic circuit based on the shape file and the condition file.

23. A speaker design support apparatus in accordance with claim 17, wherein the intermediate processing means obtains the factor of force acting on the voice coil based on the voice coil shape, the magnetic circuit shape and the magnetic flux density distribution for the magnetic circuit by means of a specific force calculating expression.

24. A speaker design support apparatus in accordance with claim 17, wherein the intermediate processing means obtains an effective vibration system mass including the voice coil based on the voice coil shape and the diaphragm shape by means of a specific effective vibration system mass calculating expression.

25. A speaker design support apparatus in accordance with claim 17, wherein the equivalent circuit design means obtains at least one of a sound pressure frequency characteristic of the speaker, an excursion frequency characteristic and an excursion margin of the diaphragm, and a impedance frequency characteristic of the speaker, by means of the equivalent circuit obtained by the calculation.

26. A speaker design support apparatus in accordance with claim 17, comprising;

selectable object storage means for storing a plurality of data to calculate at least an either shape of the voice coil and the magnetic circuit; and selecting means for selecting either one of selectable objects stored in the selectable object storage means.

27. A speaker designed by the speaker design support apparatus in accordance with claim 1.

28. A speaker design support method supporting the designing for a speaker provided with at least a voice coil, a magnetic circuit, and a diaphragm, comprising steps of;

inputting via input device design data of the voice coil, the magnetic circuit, and the diaphragm;

calculating a shape of the voice coil based on the design data of the voice coil;

calculating a shape of the magnetic circuit based on the design data of the magnetic circuit;

calculating a maximum excursion and excursion margin of the diaphragm based on the design data of the diaphragm;

deciding whether or not a fixed portion interferes in a vibration of a moving portion, by using the shape of the voice coil, the shape of the magnetic circuit, and the maximum excursion and excursion margin of the diaphragm; and displaying characteristics of the speaker based on the inputted design data, and the calculated results.

29. A speaker design support method in accordance claim 28, wherein the step of calculating is to calculate approximate values of a maximum excursion and an excursion margin of the diaphragm based on the design data of the diaphragm by means of an excursion calculating expression.

30. A speaker design support method supporting the designing for a speaker provided with at least a voice coil, a magnetic circuit, and a diaphragm, comprising steps of;

preprocessing via preprocessing device for calculating shapes of the voice coil and the magnetic circuit;

magnetic circuit designing for obtaining a magnetic flux density distribution for the magnetic circuit based on the shapes of the voice coil and the magnetic circuits;

intermediate processing for obtaining a factor of force acting on the voice coil and an effective vibration mass based on the voice coil shape, the magnetic circuit shape, and the magnetic flux density distribution for the magnetic circuit; and equivalent circuit designing for obtaining an equivalent circuit of the speaker based on the voice coil shape, the magnetic circuit shape, the factor of force action on the voice coil, and the effective vibration system mass.

31. A speaker design support method in accordance with claim 30, comprising a step of approximate excursion calculating for calculating approximate values of a maximum excursion and an excursion margin of the diaphragm based on the design data of the diaphragm.

32. A computer readable medium storing a speaker design support program supporting the designing for a speaker provided with at least a voice coil, a magnetic circuit, and a diaphragm, which makes a computer operate as;

input means for inputting design data of the voice coil, the magnetic circuit, and the diaphragm;

coil calculation means for calculating a shape of the voice coil based on the design data of the voice coil;

magnetic circuit calculation means for calculating a shape of the magnetic circuit based on the design data of the magnetic circuit;

diaphragm calculation means for calculating a maximum excursion and excursion margin of a diaphragm based on the design data of the diaphragm;

shape deciding means for deciding whether or not a fixed portion interferes in a vibration of a moving portion, by using the shape of the voice coil, the shape of the magnetic circuit, and the maximum excursion and excursion margin of the diaphragm;

display means for displaying characteristics of the speaker based on the inputted design data, and the calculated results.

33. A computer readable medium storing speaker design support program supporting the designing for a speaker provided with at least a voice coil, a magnetic circuit, and a diaphragm, which makes a computer operate as;

preprocessing means for calculating shapes of the voice coil and the magnetic circuit;

magnetic circuit design means for obtaining a magnetic flux density distribution for the magnetic circuit based on the shapes of the voice coil and the magnetic circuit;

intermediate processing means for obtaining a factor of force acting on the voice coil and an effective vibration mass based on the voice coil shape, the magnetic circuit shape, and the magnetic flux density distribution for the magnetic circuit; and equivalent circuit design means for obtaining an equivalent circuit of the speaker based on the voice coil shape, the magnetic circuit shape, the factor of force acting on the voice coil, and the effective vibration system mass.

* * * * *